US010234195B2

(12) United States Patent
Yasaka et al.

(10) Patent No.: US 10,234,195 B2
(45) Date of Patent: Mar. 19, 2019

(54) LIFTING DEVICE AND REFRIGERATOR INCLUDING THE SAME

(71) Applicant: Samsung Electronics Co., Ltd., Suwon-si, Gyeonggi-do (KR)

(72) Inventors: Yoshio Yasaka, Yokohama (JP); Kentaro Kan, Yokohama (JP); Katsumi Takenaka, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/809,754

(22) Filed: Nov. 10, 2017

(65) Prior Publication Data

US 2018/0128540 A1 May 10, 2018

(30) Foreign Application Priority Data

Nov. 10, 2016 (JP) ..... 2016-220071
May 16, 2017 (JP) ..... 2017-097286
Jun. 2, 2017 (JP) ..... 2017-110371
Jun. 9, 2017 (JP) ..... 2017-114705
(Continued)

(51) Int. Cl.

| | |
|---|---|
| ***A47B 96/04*** | (2006.01) |
| ***F25D 25/02*** | (2006.01) |
| ***B66D 1/12*** | (2006.01) |
| ***B66F 9/02*** | (2006.01) |
| ***F25D 11/00*** | (2006.01) |

(Continued)

(52) U.S. Cl.
CPC ..... *F25D 25/025* (2013.01); *B66D 1/12* (2013.01); *B66F 7/02* (2013.01); *B66F 7/28* (2013.01); *B66F 9/02* (2013.01); *F25D 11/00* (2013.01); *F25D 25/04* (2013.01)

(58) Field of Classification Search
CPC ..... A47B 51/00; A47B 2210/17; A47B 2210/175; F25D 25/022; F25D 25/025
See application file for complete search history.

(56) References Cited

U.S. PATENT DOCUMENTS 4,796,479 A * 1/1989 Wisecarver ..... F16H 1/16 192/20
5,715,759 A * 2/1998 Lee ..... A47B 9/12 108/147
(Continued)

FOREIGN PATENT DOCUMENTS

JP 3129328 B2 1/2001
JP 2004099224 A 4/2004
(Continued)

OTHER PUBLICATIONS

International Search Report regarding International Application No. PCT/KR2017/012613, dated Jan. 25, 2018, 3 pages.

*Primary Examiner* — Matthew W Ing

(57) ABSTRACT

A refrigerator includes a body and a drawer. The body includes a storage compartment. The drawer is insertable or withdrawable into or from the storage compartment. The refrigerator also includes a support configured to supports an item accommodated in the drawer. The refrigerator further includes a lifting device configured to lift the support with respect to the drawer. The lifting device includes a driving part that provides a driving force to the support, a wire that transfers the driving force of the driving part to the support, and at least one pulley which guides the wire.

20 Claims, 34 Drawing Sheets

(30) Foreign Application Priority Data

Aug. 1, 2017 (JP) ..... 2017-149492
Sep. 19, 2017 (KR) ..... 10-2017-0120357

(51) Int. Cl.
*F25D 25/04* (2006.01)
*B66F 7/02* (2006.01)
*B66F 7/28* (2006.01)

(56) References Cited

U.S. PATENT DOCUMENTS

| | | | | |
|---|---|---|---|---|
| 6,203,266 | B1 | 3/2001 | Savaria et al. | |
| 6,382,437 | B1 | 5/2002 | Okada et al. | |
| 6,510,858 | B1 | 1/2003 | Halstead et al. | |
| 2006/0022564 | A1* | 2/2006 | Oh ..... | A47B 51/00 312/402 |
| 2009/0167131 | A1 | 7/2009 | Oh et al. | |

FOREIGN PATENT DOCUMENTS

| | | | |
|---|---|---|---|
| KR | 10-2005-0081340 | A | 8/2005 |
| WO | 2014150454 | A1 | 9/2014 |

* cited by examiner

LIFTING DEVICE AND REFRIGERATOR INCLUDING THE SAME

CROSS-REFERENCE TO RELATED APPLICATIONS AND CLAIM OF PRIORITY

This application is related to and claims priority to Application Nos. JP 2016-220071, filed on Nov. 10, 2016; JP 2017-097286, filed on May 16, 2017; JP 2017-110371, filed on Jun. 2, 2017; JP 2017-114705, filed on Jun. 9, 2017; JP 2017-149492, filed on Aug. 1, 2017; and KR 10-2017-0120357, filed on Sep. 19, 2017, the contents of which are incorporated herein by reference.

TECHNICAL FIELD

Embodiments of the present disclosure relate to a lifting device and a refrigerator including the same.

BACKGROUND

Refrigerators come in a variety of forms for storing items at varying temperatures. Refrigerators typically include drawers or shelves or a combination for storing the various items. Additionally, a refrigerator can includes a lifting device for lifting relatively large and heavy items from a bottom drawer to reduce a load on a user when the user lifts the accommodated item. For example, a refrigerator can include a drawer installed in a refrigerator body and a lifting device which lifts items accommodated or located in the drawer. For example, the lifting device can include a support, a driving device, and a pair of arms. Generally a support supports items accommodated in the drawer. The driving device lifts the support. A pair of arms can be used to transfer the power of the driving device to the support. However, due to the positioning of the various components various issues can arise. For example, for the support to be lifted by the pair of arms, the pair of arms could be positioned below the support. However such a placement requires a space below the support to install the pair of arms thereby the reducing capacity of the drawer. Also, the driving device is apt to break down, during a lifting operation, if the load on the driving device is large. For example, as one end of the pair of arms is rotated and the accommodated item supported by the other end is lifted by the driving device, the load on the driving device during a lifting operation could cause the driving device is apt to break down.

SUMMARY

To address the above-discussed deficiencies, it is a primary object to provide a lifting device capable of being installed in a drawer without reducing capacity of the drawer. Also, another aspect of the present disclosure to provide a lifting device in which a load on a driving device in a lifting operation is reduced.

Additional aspects of the present disclosure will be set forth in part in the description which follows and, in part, will be obvious from the description, or may be learned by practice of the present disclosure.

In accordance with one aspect of the present disclosure, a refrigerator includes a body including a storage compartment, a drawer insertable or withdrawable into or from the storage compartment, a support which supports an item accommodated in the drawer, and a lifting device provided to lift the support with respect to the drawer. Here, the lifting device may include a driving part which provides a driving force to the support, a wire which transfers the driving force of the driving part to the support, and at least one pulley which guides the wire.

In this case, since it is possible to transfer power of a driving device to the support by a combination of the wire and the pulley, the driving device may be installed to be planar. In this viewpoint, the driving device may be installed in narrow frontward, rearward, leftward, and rightward spaces formed when the drawer is inserted into the refrigerator. Accordingly, the lifting device may be installed at the drawer of the refrigerator without reducing capacity of the drawer.

Also, in the lifting device, the pulley may include a movable pulley installed at the support, and the support may be suspended by the wire held at the movable pulley to move up or move down.

In this case, a load generated when the driving device lifts the support may be reduced by the movable pulley and accordingly the driving device may be prevented from being damaged.

Also, in the above lifting device, the driving device may include a winding and unwinding device which winds or unwinds the wire and a driving motor which drives the winding and unwinding device, and the support may be suspended by the wire wound and unwound by the winding and unwinding device to move up or move down. Also, a power transfer direction retention-support device provided between the winding and unwinding device and the driving motor may be further included. The power transfer direction retention-support device may be configured to cut off a load transferred from the wire to the winding and unwinding device not to be transferred to the driving motor.

In this case, when a great load is applied to the wire such as a case in which an item which exceeds an allowable weight of the support is accommodated in the drawer, the load may not be transferred to the driving motor through the winding and unwinding device and accordingly the driving motor may be prevented from being damaged by the load.

Also, in the lifting device which includes the power transfer direction retention-support device, the power transfer direction retention-support device may include an output shaft connected to the winding and unwinding device, an input shaft connected to the driving motor, a paddle wheel case which accommodates the output shaft and the input shaft, and a roller interposed between the output shaft and the paddle wheel case. Here, the output shaft includes a cam which retains and supports the roller and is formed on an outer circumferential surface to be opposite to the paddle wheel case. When the load applied to the wire is transferred to the output shaft through a gear device, the roller may move to a position to be engaged with the cam and the input shaft and the output shaft may be nonrotatable with respect to the paddle wheel case. Also, the input shaft may include a transfer block which moves the roller to a position not engaged with the cam while being in contact with the cam. When the power of the driving motor is transferred to the input shaft, the transfer block may come into contact with the cam and the roller may move to a position not engaged with the cam. The input shaft and the output shaft may be rotatable with respect to the paddle wheel case.

In this case, when a load is applied to the output shaft, the roller may engage with the cam such that the output shaft may become nonrotatable with respect to the paddle wheel case and the load may not be transferred from the output shaft to the input shaft. Accordingly, the support may be prevented from rapidly falling.

Also, in the lifting device, an elastic body may be installed at a part of the wire.

In this case, since tension which lifts the support occurs also at the elastic body, the load on the driving device may be reduced.

However, in the lifting device having the above-described configuration, when moving-down of the support stops due to a certain cause (for example, holding of the support and the like) during a moving-down operation, although the support stops, unwinding of the wire by the driving device continues such that the wire is deviated from the pulley or the tension of the wire is loosened.

Accordingly, an aspect of the present disclosure to stop unwinding of the wire by the driving device and to prevent occurrence of deviation of the wire from the pulley or loosening of the tension when moving-down of the support stops due to any cause during the moving-down operation. Also, the aspect is achieved by the following embodiments.

That is, the lifting device according to one aspect of the present disclosure is a lifting device which lifts an item accommodated in the drawer and includes a support which supports the item accommodated in the drawer, at least one driving device which lifts the support with respect to the drawer, at least one wire which transfers power of the driving device to the support, at least one pulley which guides the wire, a transition member which transits to a different state from a certain state according to moving-down of the support, a transition detection sensor which detects a transition amount of the transition member or a related value thereof, and a control device which stops the driving device on the basis of a change rate of the transition amount or the related value thereof detected by the transition detection sensor.

In this case, stopping of the support during the moving-down operation may be immediately detected on the basis of the change rate of the transition amount of the transition member and the driving device may be stopped. Accordingly, even when the support is stopped by any cause during the moving-down operation, since there is no unnecessary unwinding of the wire, the wire may be prevented from being deviated from the pulley or being loosened. Also, the related value of the transition amount is not a value which directly indicates the transition amount but is a value changed in relation to the transition amount and refers to, for example, a value used for calculating the transition amount.

Also, in the lifting device, the transition member may be a movable body which moves according to moving-down of the support. In this case, the movable body may be a belt and the transition detection sensor may detect a rotation amount of a rotating body which rotates according to a movement of the belt.

In this case, since the movable body moves according to moving-down of the support, stopping of the support may be detected without increasing a load on the support and the load on the driving device may be reduced.

Also, in the lifting device, the transition member may be a stretchy body which stretches according to moving-down of the support and the transition detection sensor may detect tension changing according to stretching of the stretchy body.

In this case, for example, the stretchy body may be installed to increase the tension as the support moves down and on the contrary to reduce the tension as the support moves up. Being installed as described above, the stretchy body may simply detect stopping of the support but also support moving-up of the support during a moving-up operation and simultaneously suppress rapid falling of the support. Accordingly, since in certain embodiments it is unnecessary to install another member to function the same at the lifting device, the entire lifting device may be miniaturized.

In the lifting device, the transition member may transit to a different state from a certain state according to moving-up of the support. When the transition amount detected by the transition detection sensor or the related value thereof reaches a certain value, the control device may stop the driving device.

In this case, the transition member and the transition detection sensor may be used to control a lifting position of the support during a lifting operation. Accordingly, since in certain embodiments it is unnecessary to install another member to function the same at the lifting device, the entire lifting device may be miniaturized.

Also, according to one aspect of the present disclosure, a lifting device lifts an item accommodated in a drawer and includes a support which supports an item accommodated in the drawer, a driving device configured to lift the support with respect to the drawer, a first rotating body installed at the driving device, a first wire which is wound and unwound by the first rotating body and pulls the support to allow the support to move up, a second rotating body installed at the driving device and rotates backward interworking with the first rotating body, and a second wire which is wound and unwound by the second rotating body and extended to the support in a moving-down direction.

In this case, when the support stops during the moving-down operation, it is impossible to wind the second wire extended to the support in the moving-down direction by the second rotating body such that the second rotating body may not rotate any more. Accordingly, the first rotating body interworking with the second rotating body may not rotate any more such that unwinding of the first wire which pulls the support in a moving-up direction by the first rotating body is stopped. Due thereto, even when the support stops during the moving-down operation, unnecessary unwinding of the first wire may be prevented such that the first wire may be prevented from being deviated from the pulley or being loosened in tension thereof.

The lifting device may further include a control device which stops driving of the driving device when tension of a certain level or more occurs at the second wire. In more detail, the driving device rotates the first rotating body and the second rotating body by using the driving motor. A detection device which detects a load on the driving motor may be further included. When the load detected by the detection device reaches a certain value or more, the control device may determine that the tension of the certain level or more occurs at the second wire and may stop driving of the driving motor.

In this case, when the support stops during a moving-down operation, the second wire elongated in a moving-down direction from the support is pulled by the second rotating body and the second wire can not be wound by the second rotating body such that the first rotating body and the second rotating body come into a nonrotatable state. However, since an increase in tension, generated at the second wire, is detected and the driving device is stopped, the driving device may be prevented from being damaged. That is, a great load which occurs and causes a failure of the driving device when the driving device tries to rotate the both rotating bodies in this state may be prevented. Also, as the detection device, there is an encoder capable of detecting a rotation number or a rotational speed of a driving motor, a sensor capable of detecting an overload current of the driving motor, or the like. However, the detection device is not limited thereto.

The lifting device may further include n number (n is an integer of 0 or more) of movable pulleys which guide the first wire and m number (m is an integer of 0 or more) of movable pulleys which guide the second wire. Here, the movable pulleys may be installed at the support. When the first rotating body rotates in one direction, a winding amount of the first wire by the first rotating body may be X times an unwinding amount of the second wire by the second rotating body. When the first rotating body rotates in the other direction, an unwinding amount of the first wire by the first rotating body may be X times a winding amount of the second wire by the second rotating body. When $n>m$, X may be $2(n-m)$, when $n<m$, X may be $-1/(2(n-m))$, and when $n=m$, X may be 1. Also, $n=0$ refers to a state in which there is no movable pulley which guides the first wire and $m=0$ refers to a state in which there is no movable pulley which guides the second wire.

That is, the winding amount (or the unwinding amount) of the first wire by the first rotating body and the unwinding amount (or the winding amount) of the second wire by the second rotating body change according to the numbers of the movable pulleys which guide the first wire and the second wire. In more detail, for example, when one movable pulley which guides the first wire is installed and a movable pulley which guides the second wire is not installed, the winding amount (or the unwinding amount) of the first rotating body becomes two times the unwinding amount (or the winding amount) of the second rotating body. When the number of installed movable pulleys which guide the first wire and the number of installed movable pulleys which guide the second wire are equal, the winding amount (or the unwinding amount) of the first rotating body becomes equal to the unwinding amount (or the winding amount) of the second rotating body. In this case, since a movement distance of the support according to the winding amount (or the unwinding amount) of the first wire by the first rotating body becomes equal to the unwinding amount (or the winding amount) of the second wire by the second rotating body during the lifting operation, tensions of the first wire and the second wire may be constantly maintained to be uniform. Here, expressions in which the winding amount (or the unwinding amount) of the first rotating body becomes X times or equal to the unwinding amount (or the winding amount) of the second rotating body do not exclude a case in which the wires are installed to be inclined in a lifting direction of the support or an error which occurs due to stretching and the like of the wires.

Also, in the lifting device, the first rotating body and the second rotating body may be provided to be gears which interwork with each other.

In this case, when the second rotating body becomes nonrotatable during the moving-down operation, the first rotating body may also become definitely nonrotatable due to engaged teeth. Due thereto, unwinding of the first wire by the first rotating body may be definitely stopped. Also, since the first rotating body and the second body are formed of gears, the winding amounts and the unwinding amounts of the first rotating body and the second rotating body may be easily adjusted by considering a gear ratio of the both gears, diameters of shaft cores on which wires of the both gears are wound, and numbers of movable pulleys which guide the wires. Also, the first rotating body and the second rotating body may be adjacent to each other or may be arranged with another gear therebetween.

In the lifting device, an elastic body may be installed at a part of the first wire or the second wire.

In this case, the elastic body may absorb laxity of tension which occurs at the first wire or the second wire and a state in which tension of a certain level constantly occurs may be maintained.

Also, according to one aspect of the present disclosure, a lifting device lifts an item accommodated in a drawer and includes a support which supports the item accommodated in the drawer, a plurality of driving devices which lift the support with respect to the drawer, at least one wire which transfers power of the plurality of driving devices to the support, and at least one pulley which guides the wire.

In this case, since the support is lifted by the plurality of driving devices, a load of lifting is distributed to each of the driving devices such that a load on one driving device is reduced. Accordingly, since it is possible to employ a relatively small-sized driving motor and the like as each of the driving devices, the entire lifting device may be miniaturized. Also, for example, when the driving devices are applied to a drawer of a refrigerator, a thickness of an insulator of the drawer may be secured by miniaturizing the entire lifting device to increase an insulation effect. Also, since it is possible to transfer power of the plurality of driving devices to the support by a combination of the wire and the pulley, the driving device may be installed to be planar. In this viewpoint, the driving device may be installed in narrow frontward, rearward, leftward, and rightward spaces formed when the drawer is inserted into the refrigerator. Accordingly, it is possible to maintain high capacity of the drawer.

Also, in the lifting device, the pulley may include a movable pulley installed at the support, and the support may be suspended by the wire held at the movable pulley to move up or move down.

In this case, a load generated when the driving device lifts the support is further reduced by the movable pulley.

Also, in the lifting device, the driving devices may be arranged to be linearly symmetrical with respect to a central line which divides the support into two parts in a direction perpendicular to a lifting direction.

In this case, for example, when the support is installed at a center of a door plate of the drawer, the driving devices with relatively heavy weights may be symmetrically arranged in a width direction of the drawer. Accordingly, since a weight balance with respect to left and right rails of the drawer is improved to suppress aging of the both rails, the both rails may be prevented from being damaged. That is, since the both rails innumerably slide due to insertion and withdrawal of the drawer for a long time, when the weight balance between the both rails is poor, a speed of aging of a rail with a heavy weight becomes higher. As a result thereof, the rail is damaged in early stage. However, it may be prevented by improving the weight balance between the both rails.

Also, in the lifting device in which the driving devices are arranged to be linearly symmetrical with respect to the central line, the pulleys may be arranged to be linearly symmetrical with respect to the central line and the wire may be held to be linearly symmetrical respect to the central line.

In this case, since lengths of the wires, which transfer power of the both driving devices, from the central line are equal, it is easy to control the both driving devices. That is, when the support is lifted by the plurality of driving devices, the support is lifted while being level. Accordingly, it is necessary to control winding amounts or unwinding amounts of the wires by the driving devices to be equal.

However, here, when the lengths of the wires which transfer the power of the driving devices differ from each other, it is necessary to consider both the operation amounts of the driving devices and a length ratio among the wires. Accordingly, it is difficult to control the driving devices. Also, the pulleys and the wires are arranged to be linearly symmetrical with respect to the central line to improve the weight balance between the both rails.

Also, in the lifting device, the plurality of driving devices may be one pair of driving devices and power of the pair of driving devices may be transferred to the support through one wire. Also, the power of the pair of driving devices may be transferred to the support through separate wires. In this case, the wires may be guided by separate pulleys. As described above, when the power of the driving devices is transferred to the support through a combination of the wires and the pulleys, a degree of freedom in design may be increased to build the lifting device in a narrow space.

Also, the lifting device may further include a control device which controls operations of the driving devices, and when any one of the driving devices stops, the control device may stop all the other driving devices.

In this case, when a problem occurs at any one of the driving devices, the other driving devices stop such that the other driving devices may be prevented from being secondarily damaged by continuous operation.

Also, the lifting device which includes the control device may further include a first detection device which detects operation amounts of the driving devices. The control device may compare the operation amounts detected by the first detection device and may operate the driving devices to allow the operation amounts of the driving devices to be approximately equal.

In this case, the winding amounts or the unwinding amounts of the wires of the driving devices become approximately equal such that the driving devices may be controlled to lift the support in a level state. In relation thereto, when the support is tilted, the accommodated item leans to one side of the drawer and accordingly the weight balance between the both rails becomes poor such that the rails are damaged in early stage.

Also, the lifting device which includes the control device may further a second detection device which detect operational speeds of the operation amounts of the driving devices. The control device may compare a detected operational speed of the driving device with a lowest detected operational speed detected by the second detection device with a preset upper limit of the operational speed of the corresponding driving device. When the detected operational speed exceeds the upper limit, the operational speeds of the other driving devices other than the driving device with the lowest detected operational speed are decreased. When not exceeding the upper limit, the operational speed of the driving device with the lowest detected operational speed may be increased.

In this case, there is no case in which the driving devices are driven more than upper limits of change rates of the operation amounts of the driving devices, and the loads on the driving devices are reduced to prevent the driving devices from being damaged. Also, the operational speed, for example, is a rotational speed when a power source of the driving devices is a driving motor.

Also, in the lifting device, the support may further include at least one pair of first guide rollers and at least one pair of second guide rollers installed in different positions in a direction perpendicular to the lifting direction. The first guide rollers and the second guide rollers may include rotating shafts which are perpendicular to the lifting direction and intersect with each other. Also, guides which guide the first guide rollers and the second guide rollers in the lifting direction may be further included. In this case, a position of the support may be determined by two pairs of guide rollers including rotating shafts intersecting with each other, rattling of the support which occurs while being lifted in the lifting direction may be suppressed, and the accommodated item may be stably lifted.

Also, in the lifting device, the support may further include a support arm which supports the item accommodated in the drawer, and the support arm may be installed to be attachable and detachable to and from the support. In this case, when power supply to the lifting device is cut by a power failure and the like while the support has moved up, the accommodated item may be withdrawn with the support arm and the drawer may be closed. Accordingly, interference by the accommodated item in closing the drawer may be prevented.

In the lifting device, the support may include a holding piece installed on an upper side and opened downward and a loading stand which is installed on a lower side and faces the holding piece. Also, the support arm may be installed at the support while being loaded on the loading stand when one end thereof is inserted into the holding piece.

In this case, the support arm may be easily attached to and detachable from the support without using a tool. Also, the support arm may have a shape in which the pair of bars arranged in parallel and are connected at one ends thereof. In this case, since a weight of the support arm may be decreased, the load on the driving device may be reduced. Also, in this case, the support arm may include an elastic material such as metal and the like. In the support arm, the holding piece held by the support is installed at the other ends of the pair of bars of the support arm. Here, a gap between the other ends of the pair of bars may be increased or decreased against elasticity of the support arm while the holding piece of the support arm is held by the support such that holding of the holding piece at the support may be removed to be attachable or detachable. In this case, the support arm may be easily removed from the support without using a tool.

The lifting device may further include a tensile device which constantly pulls the support in a moving-up direction.

In this case, since the support constantly remains in a state of being pulled in the moving-up direction due to the tensile device, the load on the driving device in a lifting operation may be reduced.

Also, in the lifting device, the driving device may include a driving motor, a worm gear connected to the driving motor, and a winding and unwinding device which is connected to the worm gear and winds and unwinds the wire.

In this case, even when the driving motor stops, lifting of the support is locked by the worm gear and the support is retained and supported at a height of stopping such that it is unnecessary to install an additional clutch device and the like. Also, since the worm gear is interposed between the driving motor and the winding and unwinding device, for example, even when a certain level of force of unnecessarily pushing the support downward is applied, a load on the support may be blocked by the worm gear and not transferred to the driving motor to prevent the driving motor from being damaged.

Also, in the lifting device, at least one of the first rotating body and the second rotating body may include a shaft body on which the wire is wound and a spiral-shaped groove may be installed at an outer surface of the shaft body.

In this case, when the wire is wound by the first rotating body or the second rotating body, the wire is guided along the groove of the shaft body to be wound. Accordingly, the wire may be wound on the shaft body to be aligned to suppress friction of the wire while being wound and unwound. As a result thereof, a lifespan of the wire is extended and frictional sounds may be reduced.

Also, the lifting device which does not include the power transfer direction retention-support device may further include a support retention-support device which retains and supports the support while the support has moved up. Also, the lifting device which does not include the second rotating body may further include a support retention-support device which retains and supports the support while the support has moved up and releases retention and support when an external force which is greater than a total weight of a weight of the support and a preset maximum support weight and faces in a moving-down direction is applied to the support.

In this case, even when the power transfer direction retention-support device is not installed, the support may be stably retained and supported while having moved up. Also, the maximum support weight is set to be a value lower than a maximum weight which the support actually supports, by considering safety. However, the maximum weight thereof may be set to be a set value.

Also, according to one aspect of the present disclosure, there is provided a lifting unit in which the lifting device is installed at an installation plate installed on an inside of a door plate of the drawer.

In this case, the lifting unit may be assembled separately from an assembling operation of the drawer or a body in which the drawer may be installed (for example, a refrigerator) and the lifting unit which is completed with assembling may be installed at the drawer at an appropriate time such that productivity is improved. Also, since it is possible to remove the lifting unit from the drawer to be repaired or replaced when the lifting device does not work, customer services may be improved.

Also, according to one aspect of the present disclosure, there is provided a refrigerator or a washing machine in which the drawer in which the lifting device or the lifting unit is installed is installed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 28B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, a refrigerator including a lifting device according to one embodiment of the present disclosure will be described with reference to the drawings.

Embodiment 1

Figure 1:
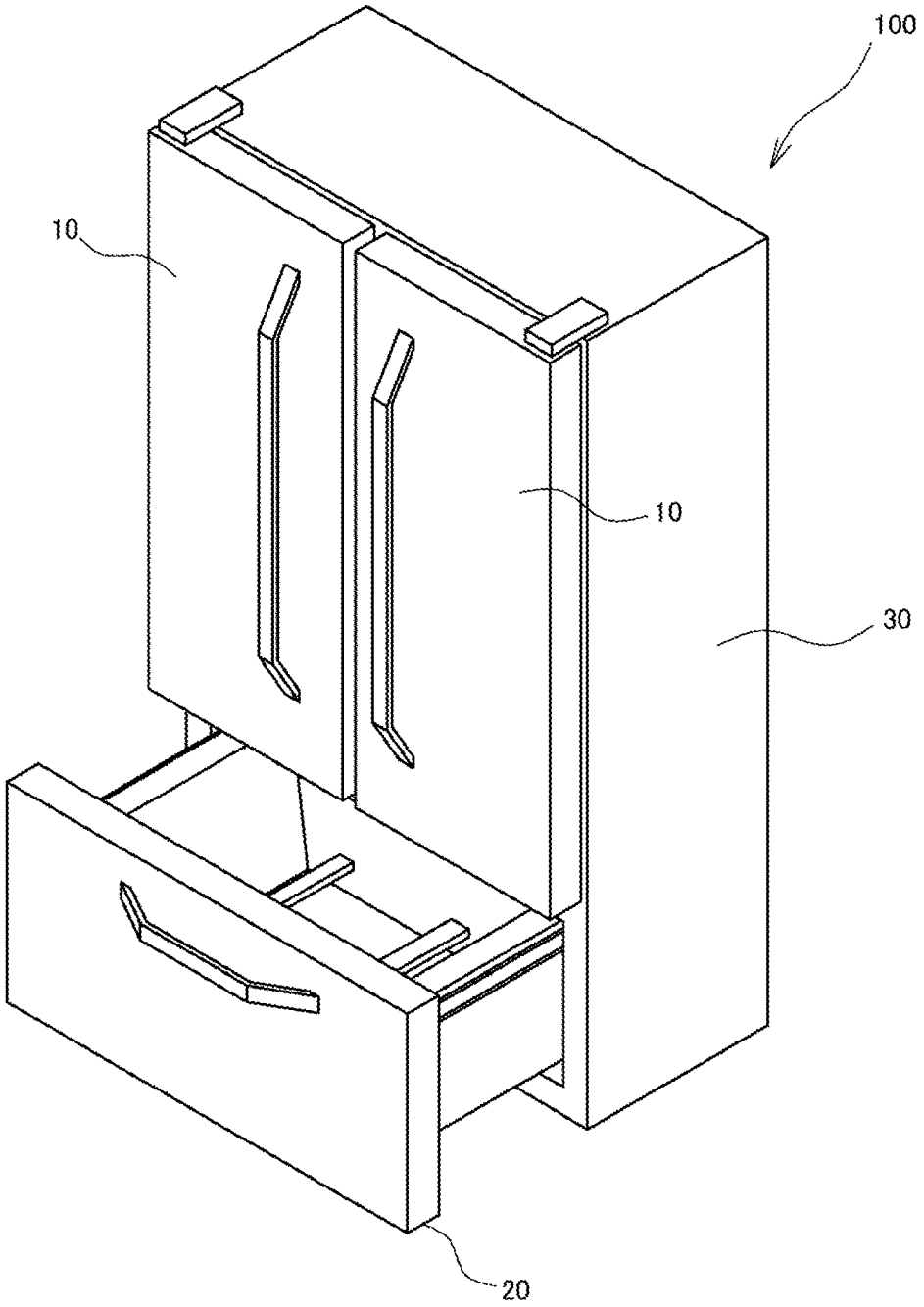
FIG. 1 illustrates a perspective view of a refrigerator including a lifting device, according to, an embodiment of the present disclosure.
Figure 2:
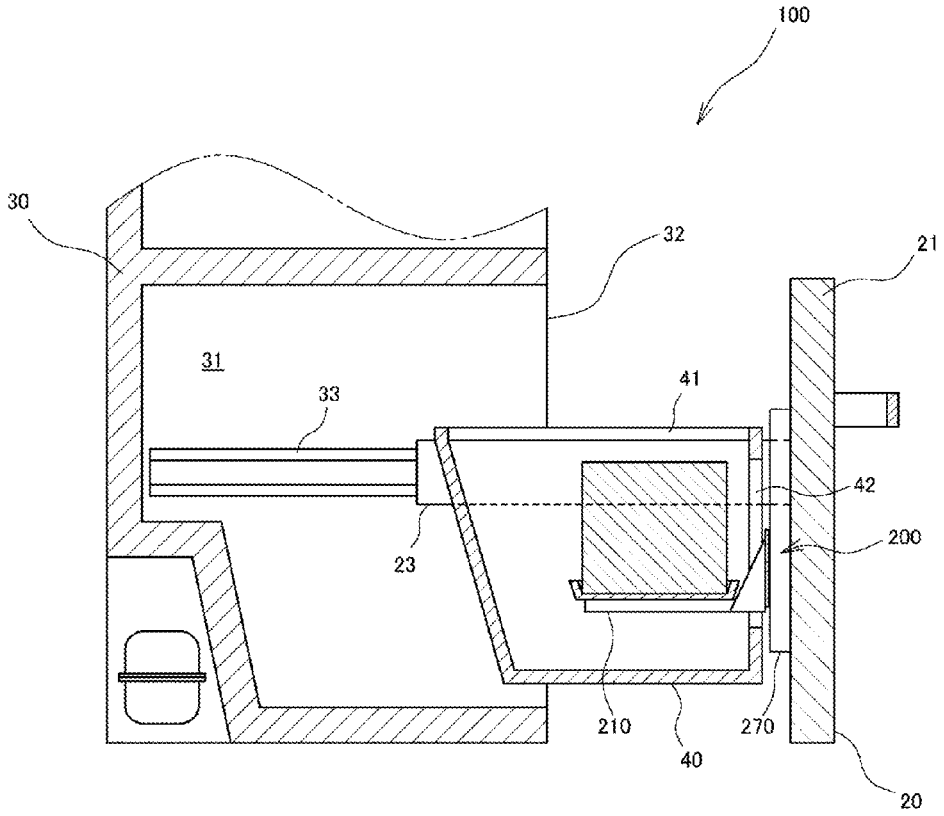
FIG. 2 illustrates a partial cross-sectional view illustrating a state in which a drawer is withdrawn from a bottom end space of the refrigerator including the lifting device, according to an embodiment of the present disclosure.

A refrigerator 100 including a lifting device 200 according to the embodiment includes doors 10 which are installed on top, divided at a center and opened leftward and rightward, and a drawer 20 installed at a bottom end as shown in FIG. 1. Also, the drawer 20 installed at the bottom end is inserted into a bottom end space 31 installed at a bottom end of a refrigerator body 30 as shown in FIG. 2. The bottom end space 31 includes an opening 32 which faces frontward, and fixed rails 33 which guide the drawer 20 are installed on both inner surfaces.

The drawer 20 includes a door plate 21 which opens and closes the opening 32 which faces a front of the bottom end space 31, the lifting device 200 installed on a rear surface of the door plate 21, a pair of guide plates 22 (refer to FIGS. 3 and 4) installed to insert the lifting device 200 into both sides of the rear surface of the door plate 21, a pair of operating rails 23 fixed to the both guide plates 22 and extended rearward, and a box case 40 installed to be held between the both operating rails 23. Also, the drawer 20 is configured to be slidable forward and backward with respect to the bottom end space 31 by inserting the pair of operating rails 23 into the fixed rails 33 installed in the bottom end space 31.

The box case 40 has an opening which faces upward, and flanges 41 for being held by the operating rails 23 are installed at both sides of the opening. Also, the box case 40 includes an insertion hole 42 formed at a front surface which faces the door plate 21 and extended upward and downward.

Figure 3:
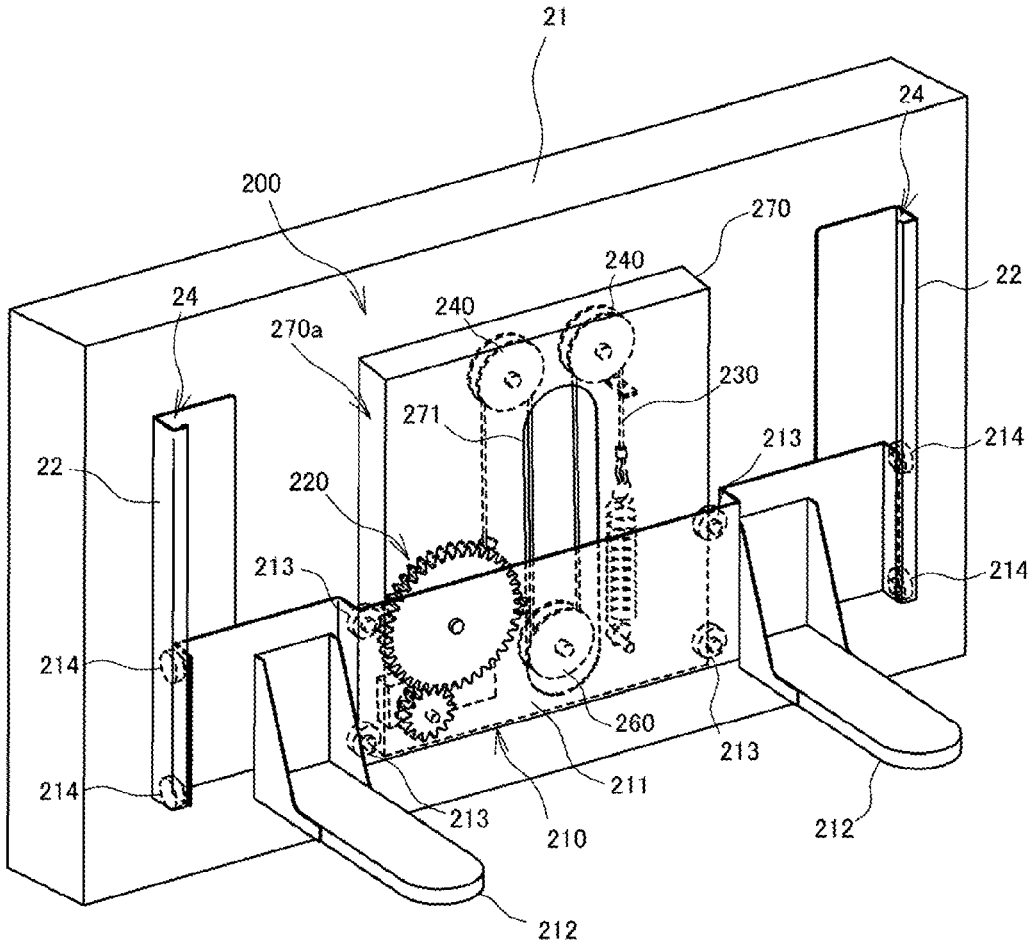
FIG. 3 illustrates a perspective view illustrating a rear surface of a door plate when a support is moved down, according to an embodiment of the present disclosure.
Figure 4:
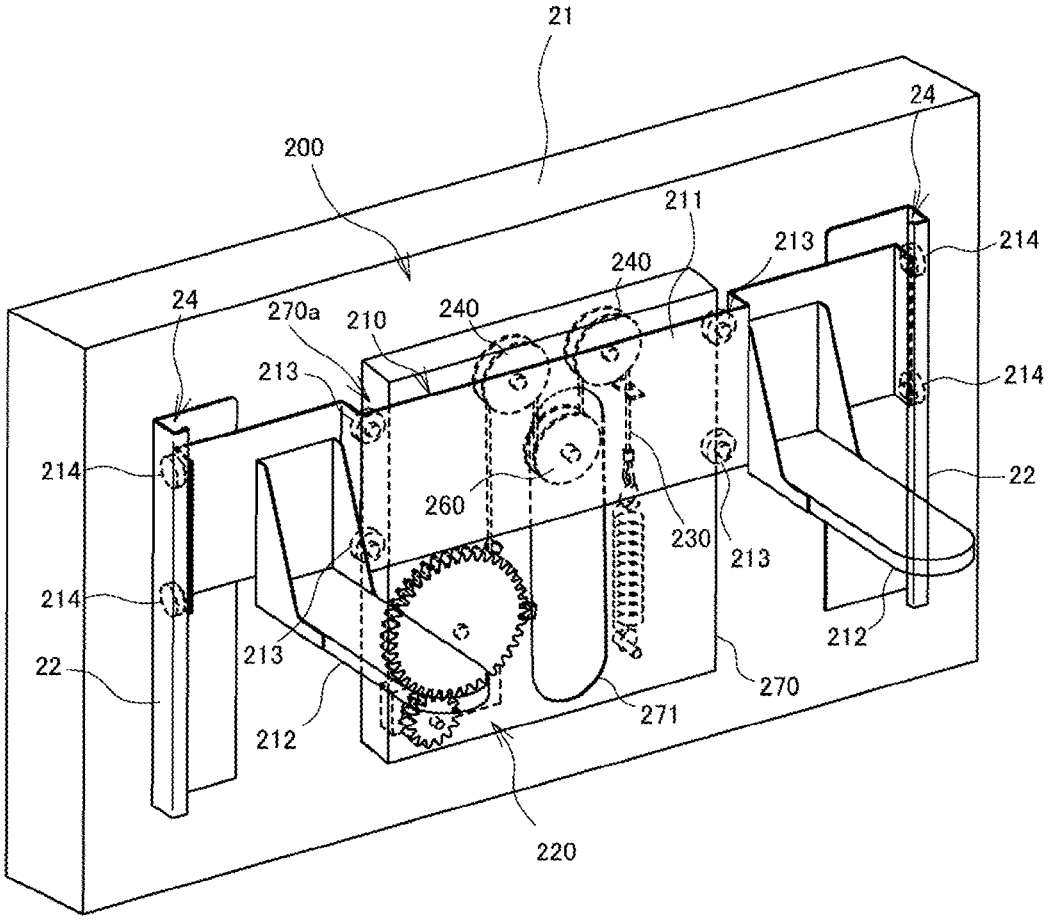
FIG. 4 illustrates a perspective view illustrating the rear surface of the door plate when the support is moved up, according to an embodiment of the present disclosure.

The lifting device 200, as shown in FIG. 3 or FIG. 4, includes a support 210 which lifts the rear surface of the door plate 21, a driving device 220 installed at the door plate 21, a wire 230 which transfers power of the driving device 220 to the support 210, and three fixed and movable pulleys 240 and 260 which guide the wire 230. Also, the driving device 220, the wire 230, and the three fixed and movable pulleys 240 and 260 are accommodated in a flat-shaped protection cover box 270 installed in a center of the rear surface of the door plate 21 and a long hole 271 extending upward and downward is formed in a center of the protection cover box 270. Also, the both guide plates 22 fixed to both sides of the rear surface of the door plate 21 include guide grooves 24 to face side surfaces of the protection cover box 270.

The support 210 includes a support plate 211 which moves up and down along the rear surface of the door plate 21 and a pair of support arms 212 fixed to the support plate 211 and inserted into the insertion hole 42 of the box case 40. The support plate 211 is formed by bending a board and has a width fitted in a space between the both guide plates 22 installed on the both sides of the rear surface of the door plate 21. Also, the support plate 211 has a central part bent along the protection cover box 270 installed at the rear surface of the door plate 21 and has step surfaces which face both side surfaces 270*a* of the protection cover box 270 with gaps therebetween. Also, the support plate 211 has both side parts bent along the guide grooves 24 of the guide plates 22 and side surfaces which face the guide grooves 24 with gaps therebetween. Also, a pair of first guide rollers 213 installed at the support plate 211 are interposed in the gaps between the step surfaces of the support plate 211 and the side surfaces 270*a* of the protection cover box 270 and guide the support 210 with the side surfaces 270*a* of the box 270 as guides. Also, a pair of second guide rollers 214 installed at the support plate 211 are interposed in gaps between the side surfaces of the support plate 211 and the guide grooves 24 and guide the support 210 with the guide grooves 24 as guides. Accordingly, the pair of first guide rollers 213 include rotation shafts elongated in a sliding direction of the drawer 20. The pair of second guide rollers 214 include rotation shafts elongated in a direction perpendicular to the sliding direction of the drawer 20 and a lifting direction of the support 210. The rotation shafts of the first guide rollers 213 and the rotation shafts of the second guide rollers 214 are perpendicular to each other. Accordingly, the support 210 is allowed to easily move up and down along the rear surface of the door plate 21 without rattling. For reference, although each of the components installed on the rear surface of the door plate 21 (the protection cover box 270 or the guide plates 22) is guided by the guide roller in the embodiment, a step and the like installed on the door plate 21 may function as a guide. Also, the support arms 212 which support accommodated items are installed to be attached or detached or both to and from the support plate 211 of the support 210.

Figure 5:
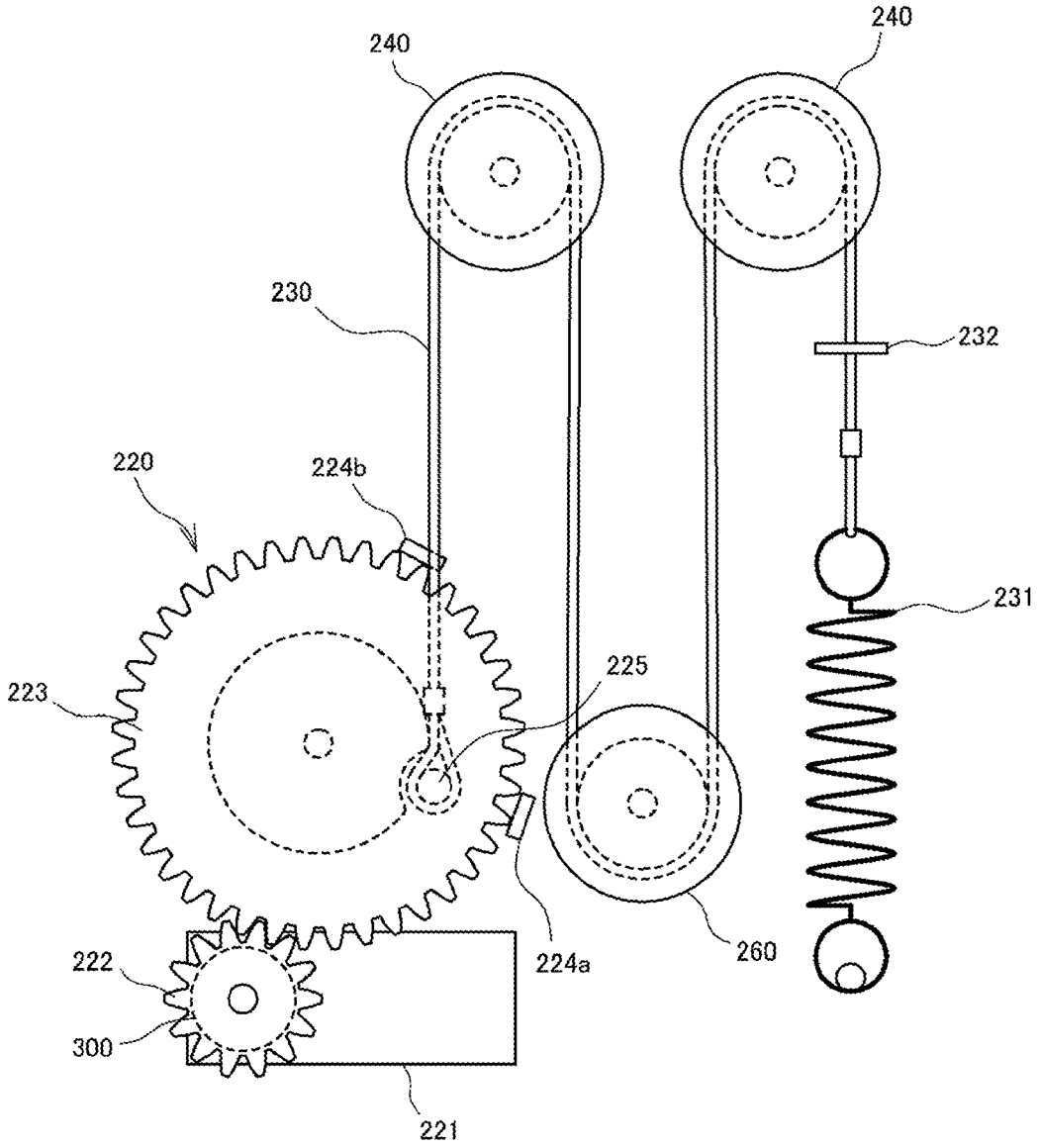
FIG. 5 illustrates a configuration diagram of the lifting device in a state in which the support is moved down, according to an embodiment of the present disclosure.
Figure 6:
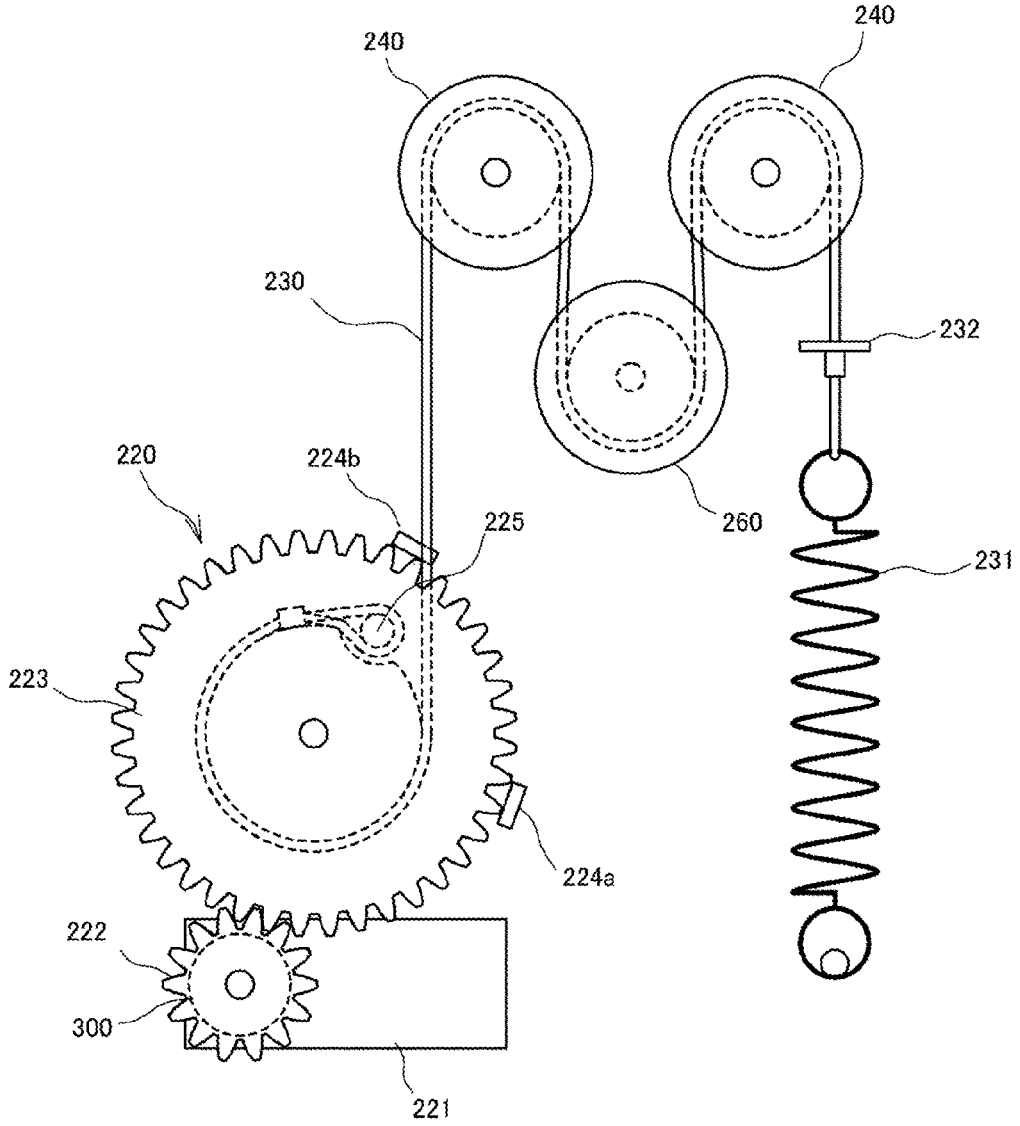
FIG. 6 illustrates a configuration diagram of the lifting device in a state in which the support is moved up, according to an embodiment of the present disclosure.

Relations among the driving device 220, the wire 230, and the three pulleys 240 and 260 accommodated in the box 270 will be described in detail on the basis of FIGS. 5 and 6. Also, FIG. 5 illustrates a state in which the support 210 is moved down and FIG. 6 illustrates a state in which the support 210 is moved up. The driving device 220 includes a driving motor 221, a first gear 222 which comes into contact with a rotating shaft of the driving motor 221 through a power transfer direction retention-support device 300, a second gear 223 which comes into contact with the first gear 222 and winds and unwinds a wire, and a pair of switch sensors 224*a* and 224*b* installed near the second gear 223. They are installed on one side below the long hole 271 in the box 270. Also, the first gear 222, the second gear 223, and the switch sensors 224*a* and 224*b* correspond to a winding-unwinding device in the following claims.

The three fixed and movable pulleys 240 and 260, as shown in FIGS. 3 and 4, include two fixed pulleys 240 and one movable pulley 260. The two fixed pulleys 240 are installed with the long hole 271 therebetween at a top in the protection cover box 270, and the one movable pulley 260 is installed at a position which faces the long hole 271 at the support plate 211. The wire 230 includes one end held by and fixed to a detection shaft 225 installed at the second gear 223, is sequentially put on one fixed pulley 240, the movable pulley 260, and the other fixed pulley 240 to be curved in an M shape en route, and includes the other end fixed to a bottom of the other side of long hole 271 in the protection cover box 270 through a spring 231 (an elastic body). Accordingly, the support 210 is suspended from the drawer 20 by the wire 230 put on the movable pulley 260. Also, a restraint plate 232 which restrains elongation of the spring 231 is fixed above the spring 231. Also, the pair of switch sensors, the first switch sensor 224*a*, and the second switch sensor 224*b* are configured to stop driving of the driving motor 221 and stop the driving of the driving motor 221 by detecting the detection shaft 225 where the wire 230 of the second gear 223 is put on and fixed to. Also, the first switch sensor 224*a*, as shown in FIG. 5, rotates in a direction in which the second gear 223 unwinds the wire 230 and is disposed near the second gear 223 to detect the detection shaft 225 when the support 210 rotates to a lowest position. The second switch sensor 224*b*, as shown in FIG. 6, rotates in a direction in which the second gear 223 winds the wire 230 and is disposed near the second gear 223 to detect the detection shaft 225 when the support 210 is moved up to a highest position.

Figure 7:
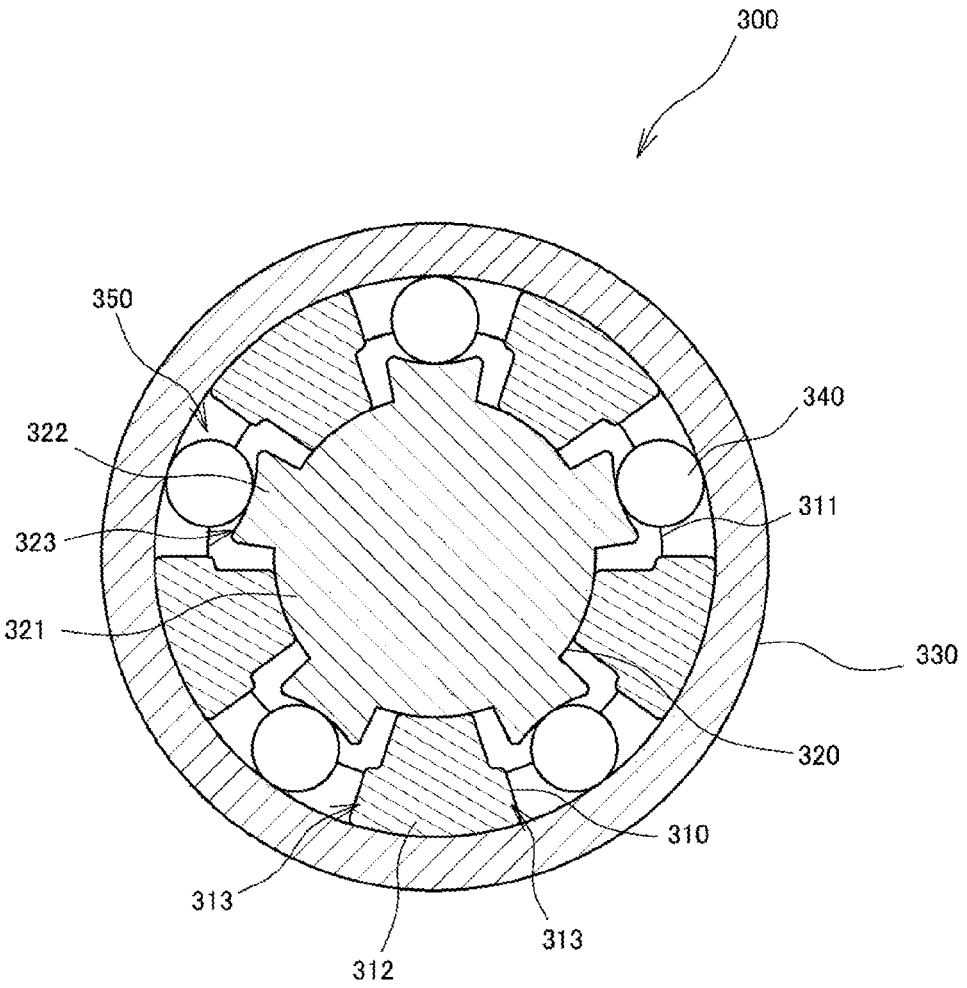
FIG. 7 illustrates a cross-sectional view illustrating a power transfer direction retention-support device, according to an embodiment of the present disclosure.

The power transfer direction retention-support device 300, as shown in FIG. 7, includes an input shaft 310 connected to the driving motor 221, an output shaft 320 connected to the first gear 222, a paddle wheel case 330 which accommodates the input shaft 310 and the output shaft 320, and a plurality of rollers 340 interposed between the input shaft 310 and the paddle wheel case 330. Both the input shaft 310 and the output shaft 320 are arranged in a serial shape along a central shaft of the paddle wheel case 330 and have rotating shafts coinciding with the central shaft.

The output shaft 320 includes an output shaft body 321 which includes one end protruding outward from the paddle wheel case 330 and the other end positioned in the paddle wheel case 330 and a plurality of cams 322 arranged for each equiphase with respect to an outer circumferential surface of the other end of the output shaft body 321 and protruding toward an inner circumferential surface of the paddle wheel case 330. Also, each of the cams 322 includes a cam surface 323 which faces the inner circumferential surface of the paddle wheel case 330 with a gap therebetween, and the cam surface 323 has a concave circular arc shape. Accordingly, a retention-support space 350 is installed between the cam surface 323 of each of the cams 322 and the inner circumferential surface of the paddle wheel case 330 to retain and support the cylinder-shaped rollers 340 therebetween. Also, a distance of the retention-support space 350 in a diameter direction is longest at a center of the cam surface 323 and gradually shortens toward both ends of the cam surface 323. Accordingly, when a contact position between each of the rollers 340 and the cam surface 323 is at the center of the cam surface 323, rotation of the output shaft 320 with respect to the paddle wheel case 330 is not restrained by each of the rollers 340. On the other hand, when the contact position between each of the rollers 340 and the cam surface 323 deviates by a certain degree from the center of the cam surface 323, the rotation of the output shaft 320 with respect to the paddle wheel case 330 is restricted by each of the rollers 340.

The input shaft 310 includes an input shaft body 311 positioned in the paddle wheel case 330 and a plurality of transfer blocks 312 elongated from one end of the input shaft body 311 to surround the other end of the output shaft body 321 and positioned between the cams 322. Also, each of the transfer blocks 312 includes an inner circumferential surface in contact with the outer circumferential surface of the output shaft body 321 and an outer circumferential surface in contact with the inner circumferential surface of the paddle wheel case 330. Here, a width of the inner circumferential surface is smaller than a width of the outer circumferential surface. Also, an inner circumference of each of the transfer blocks 312 has a width smaller than a distance between the cams 322 interposing the transfer block 312 therebetween and may be spaced from or in contact with the both cams 322 with gaps installed therebetween. Also, each of the transfer blocks 312 includes restraint pieces 313 which protrude in a circumferential direction further than side surfaces near the inner circumference which faces the cams 322 are installed on side surfaces near the outer circumference which faces the rollers 340. Also, the restraint pieces 313 are inserted in the retention-support space 350 to restrain rolling motion of the rollers 340 with respect to the retention-support space 350 when the side surfaces near the inner circumference of the transfer block 312 are in contact with the cams 322. Also, the rollers 340 come into contact with the center of the cam surface 323 while being in contact with the restraint piece 313.

Figure 8A:
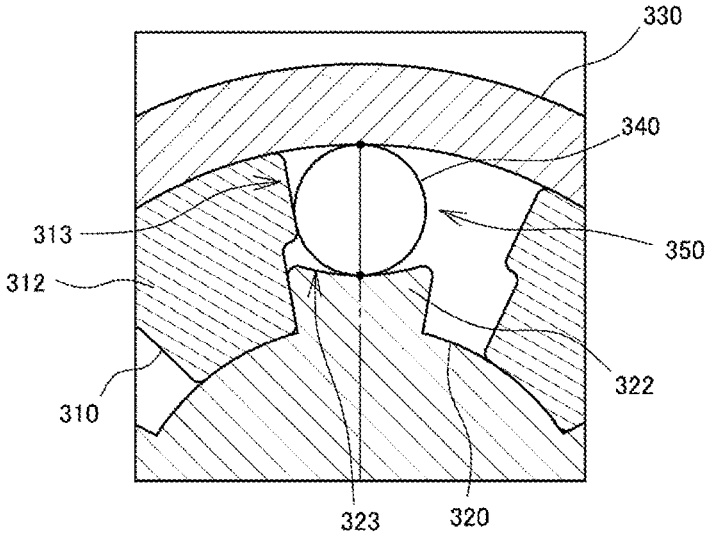
FIGS. 8A, 8B, and 8C illustrate partial cross-sectional views illustrating a power transfer state, a reversal clutch state, and a forward rotation clutch state of the power transfer direction retention-support device, according to an embodiment of the present disclosure.

In the case of the power transfer direction retention-support device 300 having the above-described configuration, first, as shown in FIG. 8A, when torque (power) is transferred from the driving motor 221 to the input shaft 310 in a certain rotation direction (a rightward rotation direction in FIG. 8A), the input shaft 310 rotates in the certain rotation direction in the paddle wheel case 330, one of side surface of the inner circumference of each of the transfer blocks 312, which faces in the certain rotation direction, comes into contact with the cam 322, and concomitantly, the restraint pieces 313 of each of the transfer block 312 are inserted into the retention-support space 350. Accordingly, the rolling motion of the rollers 340 in a rotation direction opposite to the certain rotation direction (hereinafter, referred to as "an opposite rotation direction") in the retention-support space 350 is restrained by the restraint pieces 313 and a contact position of the rollers 340 with the cam surface 323 does not move from the center in the opposite rotation direction. In this state, when the input shaft 310 rotates with the output shaft 320 in the certain rotation direction in the paddle wheel case 330, the rollers 340 comes into contact with the restraint piece 313 and the center of the cam surface 323 at the same time. Since rotation of the rollers 340 with respect to the output shaft 320 is not restrained, the power of the driving motor 221 is transferred to the first gear 222 through the power transfer direction retention-support device 300, which is referred to as a power transfer state. Also, the power transfer direction retention-support device 300 shifts to the power transfer state in which the power is transferred from the driving motor 221 to the input shaft 310 even when the a power rotation direction of the driving motor 221 is any one of a rightward rotation direction and a leftward rotation direction.

Figure 8B:
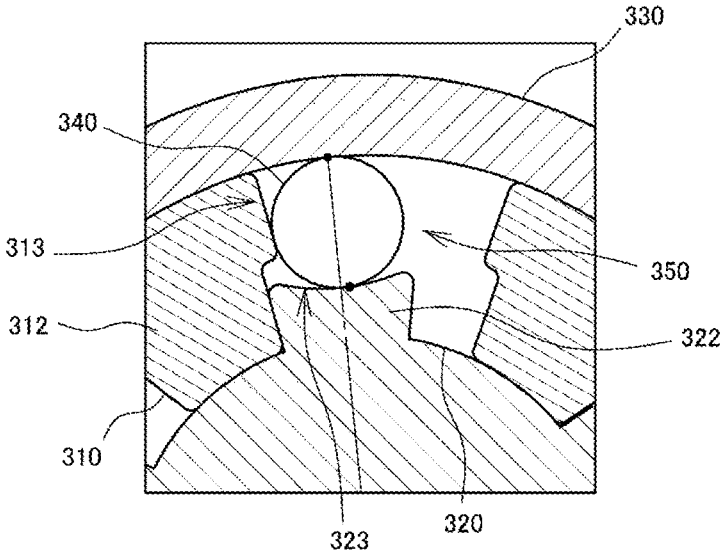
Figure 8C:
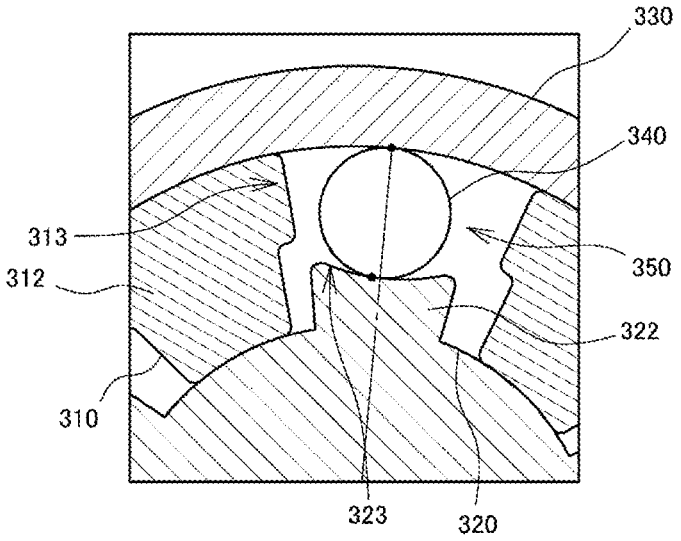

Sequentially, as shown in FIG. 8B, in the power transfer state, when the torque applied to the input shaft 310 in the certain rotation direction (a rightward rotation direction in FIG. 8B) decreases or high torque is applied to the output shaft 320 in the opposite rotation direction, the output shaft 320 rotates with the input shaft 310 in the opposite rotation direction in the paddle wheel case 330. Here, since the rolling motion of the rollers 340 in the certain rotation direction in the retention-support space 350 is not restrained, the contact position of the rollers 340 with the cam surface 323 moves from the center in the certain rotation direction. Accordingly, rotation of the rollers 340 with respect to the output shaft 320 is restrained and a load on the output shaft 320 in the opposite rotation direction is blocked by the power transfer direction retention-support device 300 and not transferred to the driving motor 221, which is referred to as a reverse lock state. Also, as shown in FIG. 8C, in the power transfer state, when high torque in the certain rotation direction is applied to the output shaft 320, the output shaft 320 rotates in the certain rotation direction in the paddle wheel case 330 at a speed higher than that of the input shaft 310 which rotates in the certain rotation direction in the paddle wheel case 330. Here, since the rolling motion of the rollers 340 in the certain rotation direction in the retention-support space 350 is not restrained, the contact position of the rollers 340 with the cam surface 323 moves from the center in the opposite rotation direction. Accordingly, rotation of the rollers 340 with respect to the output shaft 320 is restrained and a load on the output shaft 320 in the certain rotation direction is blocked by the power transfer direction retention-support device 300 and not transferred to the driving motor 221, which is referred to as a forward rotation lock state. Also, in the forward rotation lock state, if a force of the output shaft 320 to rotate the rollers 340 in the certain rotation direction is greater than a force of the input shaft 310 to rotate the rollers 340 in the certain rotation direction, then the lock state is maintained.

Also, although not shown in the drawings, the power transfer direction retention-support device 300 and the driving motor 221 are connected by inserting a rotating shaft which protrudes from the driving motor 221 into a connection hole installed at the input shaft body of the input shaft 310. The power transfer direction retention-support device 300 and the first gear 222 are connected by inserting one end of the output shaft body 321 which protrudes from the paddle wheel case 330 of the output shaft 320 into a connection hole installed at the first gear 222. Accordingly, the power transfer direction retention-support device 300 is interposed between the driving motor 221 and the first gear 222.

Also, the lifting device includes a controller which is not shown, and the controller is connected to an input means which includes a moving-up button and a moving-down button installed on an outer wall surface of the refrigerator. Also, the controller is configured by a so-called computer which includes a central processing unit (CPU), a memory, AD/DA converters, input/output means, and the like and is configured to perform a function by executing a program stored in the memory and allowing various types of devices to cooperate.

Sequentially, an operation of the lifting device 200 according to the embodiment will be described.

First, when a user withdraws the drawer 20 from the bottom end space 31 of the refrigerator body 30 and pushes the moving-up button of the input means, the controller drives the driving motor 221 to perform a moving-up operation. In detail, as shown in FIGS. 5 and 6, when the driving motor 221 is driven, torque in one rotation direction of the driving motor 221 (a leftward rotation direction in FIG. 5) is transferred to the input shaft 310 of the power transfer direction retention-support device 300 such that the power transfer direction retention-support device 300 shifts to the power transfer state and the torque of the driving motor 221 is transferred to the first gear 222 and the second gear 223 through the power transfer direction retention-support device 300. Accordingly, the second gear 223 rotates in a direction of winding the wire 230, the movable pulley 260 moves up according to a winding amount of the wire 230 by the second gear 223, and concomitantly, the support 210 connected to the movable pulley 260 is guided to the guide grooves 24 and moved up while being suspended by the wire 230. Also, when the second gear 223 rotates by a certain angle in one forward rotation direction and the second switch sensor 224*b* detects the detection shaft 225, the controller stops driving of the driving motor 221 on the basis of a detection signal received from the second switch sensor 224*b* (refer to FIG. 6). Here, to allow the lifting device 200 to most move up the support 210 with respect to the drawer 20, a length of the wire 230 and the like is adjusted by the second gear 223. Also, when a load is applied in a direction of moving down the support 210 or the driving of the driving motor 221 stops during the moving-up operation, the power transfer direction retention-support device 300 shifts to the reverse lock state and transfer of the load to the driving motor 221 is blocked to prevent the driving motor 221 from being damaged.

Sequentially, when the user pushes the moving-down button of the input means, the controller drives the driving motor 221 to perform a moving-down operation. In detail, as shown in FIGS. 5 and 6, when the driving motor 221 is driven, torque in the other rotation direction of the driving motor 221 (a rightward rotation direction in FIG. 6) is transferred to the input shaft 310 of the power transfer direction retention-support device 300 such that the power transfer direction retention-support device 300 shifts to the power transfer state and the torque of the driving motor 221 is transferred to the first gear 222 and the second gear 223 through the power transfer direction retention-support device 300. Accordingly, the second gear 223 rotates in a direction of unwinding the wire 230, the movable pulley 260 moves down according to an unwinding amount of the wire 230 by the second gear 223, and concomitantly, the support 210 connected to the movable pulley 260 is guided to the guide grooves 24 and moved down while being suspended by the wire 230. Also, when the second gear 223 rotates by a certain angle in the other rotation direction and the first switch sensor 224*a* detects the detection shaft 225, the controller stops driving of the driving motor 221 on the basis of a detection signal received from the first switch sensor 224*a*. Here, to allow the lifting device 200 to most move down the support 210 with respect to the drawer 20, the length of the wire 230 and the like is adjusted by the second gear 223. Also, a load is applied in a direction of moving down the support 210 during the moving-down operation, the power transfer direction retention-support device 300 shifts to the forward rotation lock state. When the driving of the driving motor 221 stops, the power transfer direction retention-support device 300 shifts to the reverse lock state and transfer of the load to the driving motor 221 is blocked to prevent the driving motor 221 from being damaged in any state.

In this case, since one movable pulley 260 is used as a pulley which guides the wire 230 in the lifting device 200, a force necessary for moving up the support 210 by pulling the wire 230 becomes ½ to reduce a load on the driving motor 221 to ½. Also, since the spring 231 is installed at the other end of the wire 230, when the second gear 223 winds the wire 230, the spring 231 is elongated to increase tension according thereto and then the tension moves up the support 210 through the wire 230. Accordingly, as the support 210 moves up with respect to the drawer 20, support by the spring 231 increases such that a load on the driving motor 221 may be reduced. Also, although the spring 231 is used in the embodiment, any elastic body which increases in tension as being elongated, for example, rubber and the like may be used. Also, although the elastic body is installed at the other end of the wire 230 in the embodiment, an elastic body may be installed in the middle. In this case, the elastic body may not interfere in being swept from a pulley.

Also, in the embodiment, the box case 40 held by the pair of operating rails 23 installed at the door plate 21 of the drawer 20 is included, the pair of supports 210 are configured to move up and down in the box case 40, and accommodated items are moved up and down through a tray installed on the pair of supports 210 (refer to FIG. 2). However, it is not limited thereto and the box case 40 may accommodate items and may be moved up and down by the pair of supports 210. Otherwise, the box case 40 may not be installed and a tray on which items are disposed may be moved up and down by the pair of supports 210. The box case 40 or a tray may be integrated with the supports 210. Also, other configurations are available. Also, the member of the support 210, connected to the lifting device 200, has a support plate having a plate shape but is not limited thereto. Any support bodies capable of bearing a weight of an accommodated item may be available, and support arms which support the accommodated item may be installed to be attached or detached or both to and from the support body. Also, as means for installing support arms to the support body, in detail, a support arm may be installed at a support body by using a screw or a pin and then the pin or screw may be removed. Otherwise, a hook may be installed at any one of a support body or a support arm and a holding hole which holds the hook may be installed at the other thereof and then the hook may be held by the holding hole and fixed thereto. Also, other installing means may be used. Also, in the embodiment, there are installed two support arms 212. In an embodiment one support arm may be installed. In another embodiment two or more support arms may be installed. Also, in the embodiment, gears are used as winding-unwinding devices. However, winding-unwinding devices are not limited thereto. For example, pulleys may come into in direct contact with the power transfer direction retention-support device 300, and the wire 230 may be wound and unwound by the pulleys.

In the embodiment, as one of the pulleys which guide the wire 230 of the lifting device 200, one movable pulley 260 installed at the support 210 is used. However, a plurality of such movable pulleys may be provided. When the number n of movable pulleys is increased, a load for moving up a support is reduced by (½)n such that a load on the driving motor 221 may be further reduced.

Also, in the embodiment, a user performs a lifting operation of the lifting device by operating input means. However, an opening detection sensor which detects whether a drawer is withdrawn from a bottom end space of a refrigerator body may be installed, and a controller may allow the lifting device to perform a moving-up operation when detection information detected by the opening detection sensor is received. Also, lifting of the lifting device may be performed by inputting a voice.

Also, in the embodiment, two pairs of first guide rollers and two pairs of second guide rollers are installed with respect to a support. However, one pair of first guide rollers and one pair of second guide rollers may be installed with respect to a support. In this case, when a line which connects the pair of first guide rollers and a line which connects the pair of second guide rollers are alternately arranged, it is possible to increasingly restrain rattling of the support. Also, two or more guide rollers on both sides may be installed with respect to a support.

Embodiment 2

Figure 9:
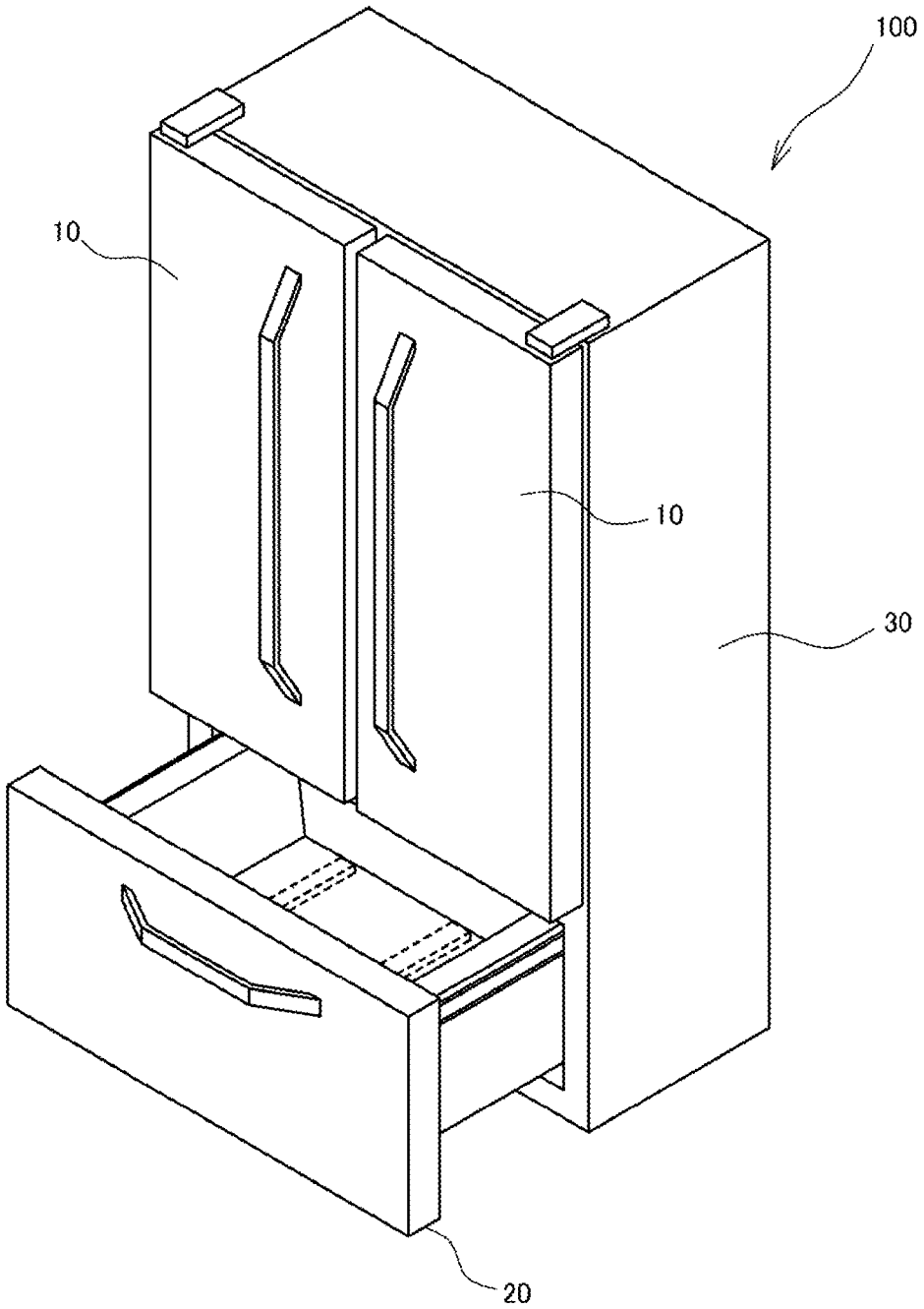
FIG. 9 illustrates a perspective view of a refrigerator including a lifting device, according to a second embodiment of the present disclosure.
Figure 10:
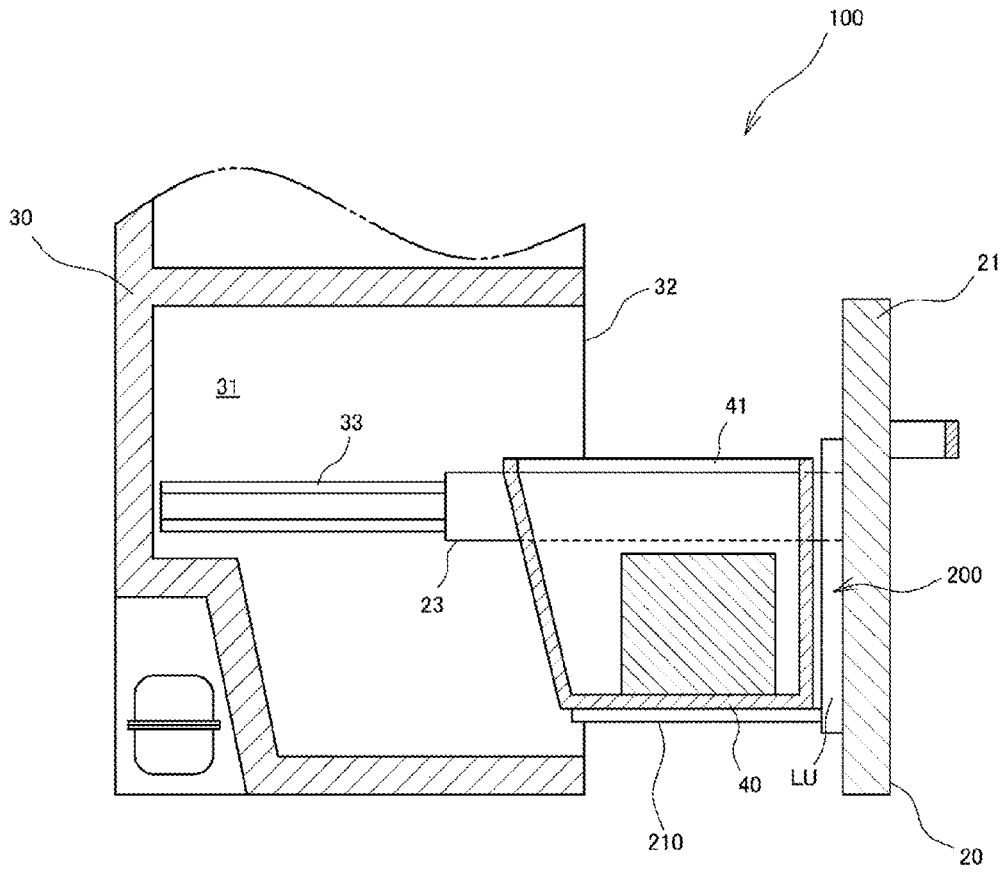
FIG. 10 illustrates a partial cross-sectional view illustrating a state in which a drawer is withdrawn from a bottom end space of the refrigerator including the lifting device, according to a second embodiment of the present disclosure.

A refrigerator 100 including a lifting device 200 according to the embodiment, as shown in FIG. 9, includes doors 10 which are installed on top, divided at a center and opened leftward and rightward, and a drawer 20 installed at a bottom end. Also, the drawer 20 installed at the bottom end is inserted into a bottom end space 31 installed at a bottom end of a refrigerator body 30 as shown in FIG. 10. The bottom end space 31 includes an opening 32 which faces frontward, and fixing rails 33 which guide the drawer 20 are installed on both inner surfaces.

The drawer 20 includes a door plate 21 which opens and closes the opening 32 which faces a front of the bottom end space 31, a lifting unit LU installed on a rear surface of the door plate 21, a pair of operating rails 23 installed on both sides of the rear surface of the door plate 21 with the lifting unit LU interposed therebetween and extending backward, and a box case 40 installed to held between the both operating rails 23. Also, the drawer 20 is configured to be slidable forward and backward with respect to the bottom end space 31 by inserting the pair of operating rails 23 into the fixed rails 33 installed in the bottom end space 31.

The box case 40 has an opening which faces upward, and flanges 41 for being held by the operating rails 23 are installed at both sides of the opening. Also, items are accommodated in the box case 40.

Figure 11:
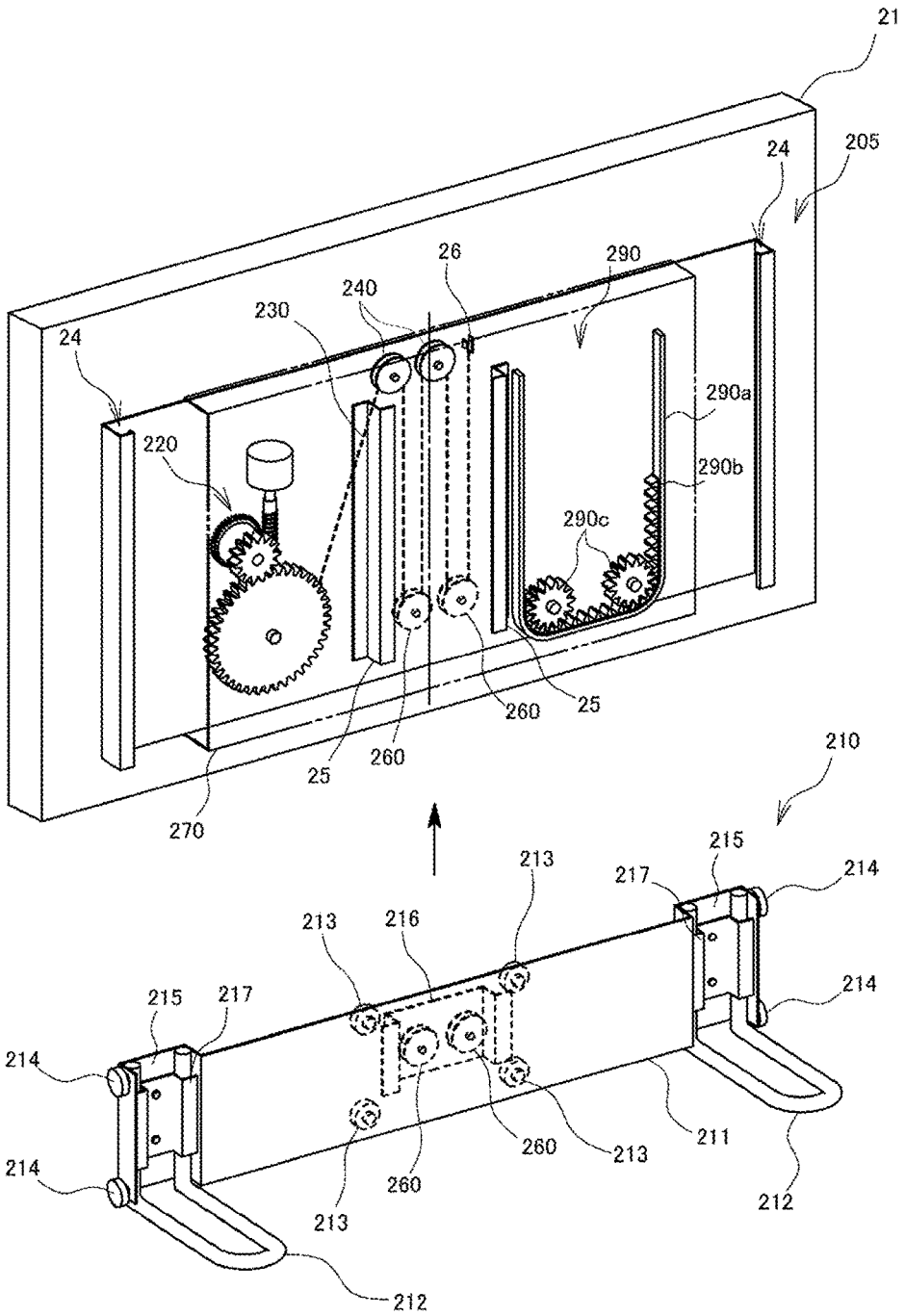
FIG. 11 illustrates a perspective view illustrating a rear surface of a door plate, according to a second embodiment of the present disclosure.

The lifting unit, as shown in FIG. 11, includes an installation plate 205 installed on the rear surface of the door plate 21, a support 210 which moves up and down with respect to the installation plate 205, a driving device 220 installed at the installation plate 205, a wire 230 wound and unwound by the driving device 220 to pull the support 210 upward, four fixed and movable pulleys 240 and 260 which guide the wire 230, and a detection device 290 which detects a movement amount of the support 210 and a change rate of the movement amount. In relation thereto, FIG. 11 illustrates a state in which the support 210 is removed from the installation plate 205. Also, in FIG. 11, it is assumed that the support 210 is installed at the installation plate 205, and the wire 230 and the movable pulleys 260 are partially shown as dotted lines to show position-relations among the wire 230 and the fixed and movable pulleys 240 and 260.

Also, the driving device 220, the wire 230, the fixed and movable pulleys 240 and 260, and the detection device 290, installed at the installation plate 205, are accommodated in a protection cover box 270 (shown as a double dot-and-dash line in FIG. 11) installed to cover a center of the installation plate 205. Accordingly, the driving device 220, the wire 230, the fixed and movable pulleys 240 and 260, and the detection device 290 are not exposed to be prevented from being swept by the driving device 220 and the like to improve safety.

The installation plate 205 is formed by bending a panel and has a width narrower than a width of the door plate 21. In detail, the installation plate 205 is bent to allow both sides thereof to form guide grooves 24 which face a center in a width direction. Also, guide plates 25 are symmetrically installed at the installation plate 205, with the center in the width direction interposed therebetween. Also, at the installation plate 205, the driving device 220 is installed between the guide groove 24 and the guide plates 25 on one side, two fixed pulleys 240 are installed at a top between the both guide plates 25, and a hook 26 is installed in parallel to the two fixed pulleys 240.

Also, the detection device 290 is installed between the guide groove 24 and the guide plates 25 on the other side of the installation plate 205. The detection device 290 includes a guide rail 290*a* with both ends elongated along a lifting direction of the support 210 and having an approximate U shape, a belt 290*b* which slides on the guide rail 290*a*, a pair of guide gears 290*c* which rotate according to sliding of the belt 290*b*, and an encoder (not shown) which measures a rotation number of the guide gear 290*c* on one side.

Also, the belt 290*b* includes rack-shaped teeth installed on one surface and has flexibility of being deformed along a curve of the guide rail 290*a*. Also, the belt 290*b* passes between the guide rail 290*a* and each of the guide gears 290*c*. In this state, the teeth installed on the one surface engage with teeth of each of the guide gears 290*c*. Accordingly, the belt 290*b* is allowed to slide along the guide rail 290*a* such that each of the guide gears 290*c* is allowed to rotate. Also, the belt 290*b* is configured to have one end connected to the support 210 and moving along the lifting direction of the support 210 according to lifting of the support 210.

Accordingly, the detection device 290 is configured to detect a movement amount of the support 210 on the basis of the rotation number of the guide gear 290*c* measured by the encoder and also detect a change rate of the movement amount of the support 210 on the basis of a change rate of the rotation number. Accordingly, the belt 290*b* corresponds to a transition member (a movable body) in the claims, the encoder corresponds to a transition detection sensor in the claims, and the number of rotation is a transition amount in the claims.

The support 210 includes a support plate 211 which moves up and down along the installation plate 205 and a pair of support arms 212 which are fixed to the support plate 211 and support the box case 40 at a bottom surface.

The support plate 211 is formed by bending a panel and has a width slightly narrower than the width of the installation plate 205. In detail, the support plate 211 has a shape in which a central part follows an inner surface of the protection cover box 270 and both sides are bent to form concave grooves 215 for installing the support arms 212. Also, a support box 216 is installed at the central part of the support plate 211 on a surface which faces the installation plate 205, and one pair of first guide rollers 213 are installed with gaps from side surfaces of the support box 216. Also, the pair of first guide rollers 213 guide the support 210 with the guide plates 25 inserted into the gaps from the support box 216 as guides. Also, one pair of second guide rollers 214 are installed on both sides of the support plate 211, on sidewalls which face the guide grooves 24 of the concave grooves 215. Also, the pair of second guide rollers 214 guide the support 210 with the guide grooves 24 as guides. Accordingly, the pair of first guide rollers 213 include rotating shafts elongated to be perpendicular to the installation plate 205, the pair of second guide rollers 214 include rotating shafts elongated in parallel to the installation plate 205, and the first guide rollers 213 and the second guide rollers 214 have the rotating shafts perpendicular to each other. Accordingly, the support 210 may easily move up and down along the installation plate 205 without rattling.

Also, one pair of movable pulleys 260 are installed in the support box 216 of the support plate 211. Also, the support box 216 has a width which fits between both the guide plates 25 such that the support 210 may easily move up and down along the installation plate 205 without rattling.

Figure 13:
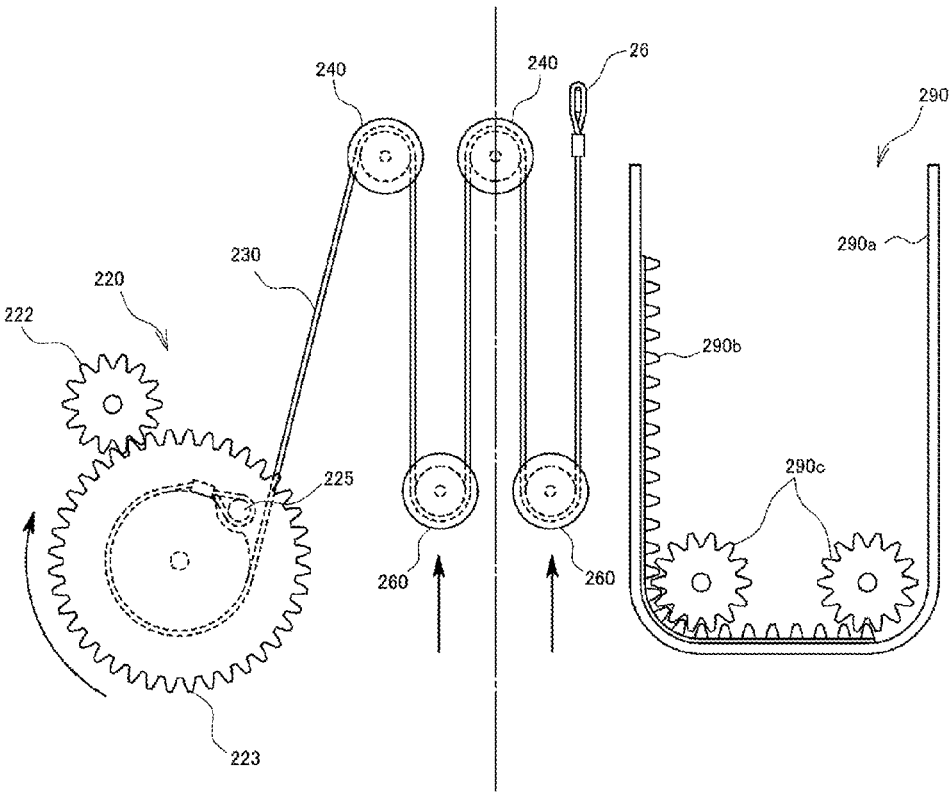
FIG. 13 illustrates a configuration diagram illustrating a movement during a moving-up operation of a support according to Embodiment 2.
Figure 14:
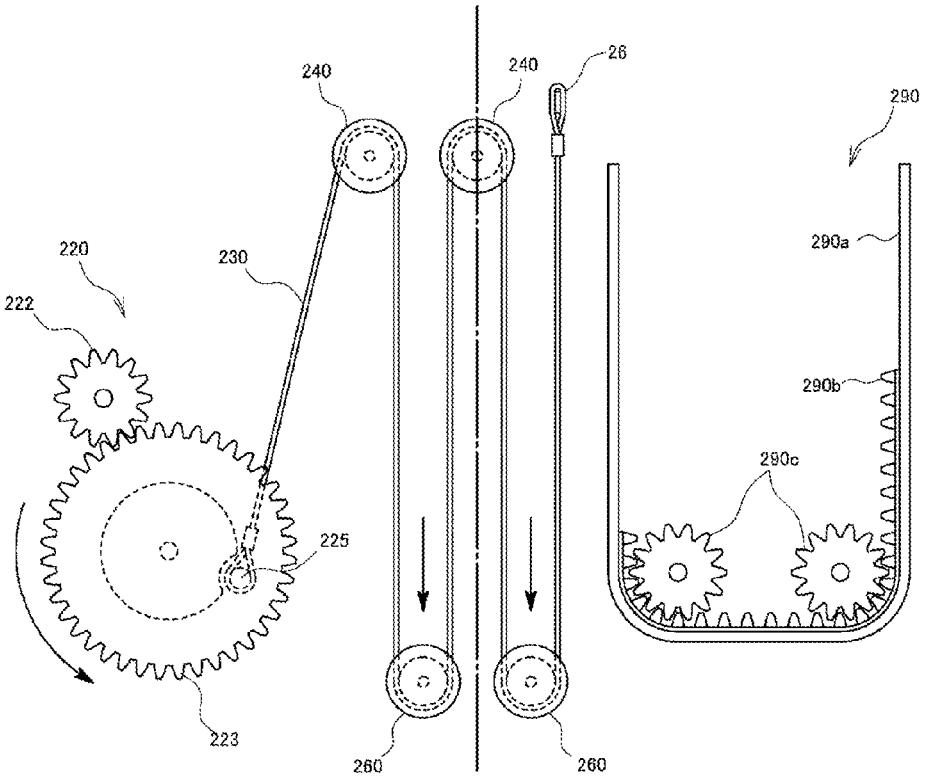
FIG. 14 illustrates a configuration diagram illustrating a movement during a moving-down operation of the support, according to a second embodiment of the present disclosure.

Accordingly, as shown in FIGS. 13 and 14, the two fixed pulleys 240 installed at the top of the installation plate 205 and the two movable pulleys 260 installed at the support plate 211 guide the wire 230 connected to the driving device 220.

Also, although not shown in the drawings, the support plate 211 includes a plurality of reducing holes within a range of maintaining strength thereof, to reduce a weight thereof.

The support arms 212, as shown in FIG. 11, are formed by bending a rod and has a shape in which a pair of L-shaped bars arranged in parallel are connected to each other at ends thereof. Also, both ends of the support arms 212 are inserted into the concave grooves 215 of the support plate 211, and the support arms 212 are fixed to the support plate 211 by fixing plate 217 screw-fixed to the concave grooves 215. Accordingly, the support arms 212 may be configured to be attached to or detached from the support plate 211 or adjusted in a height in a lifting direction of the support plate 211 by tightening or loosening a screw of the fixing plate 217.

Figure 12:
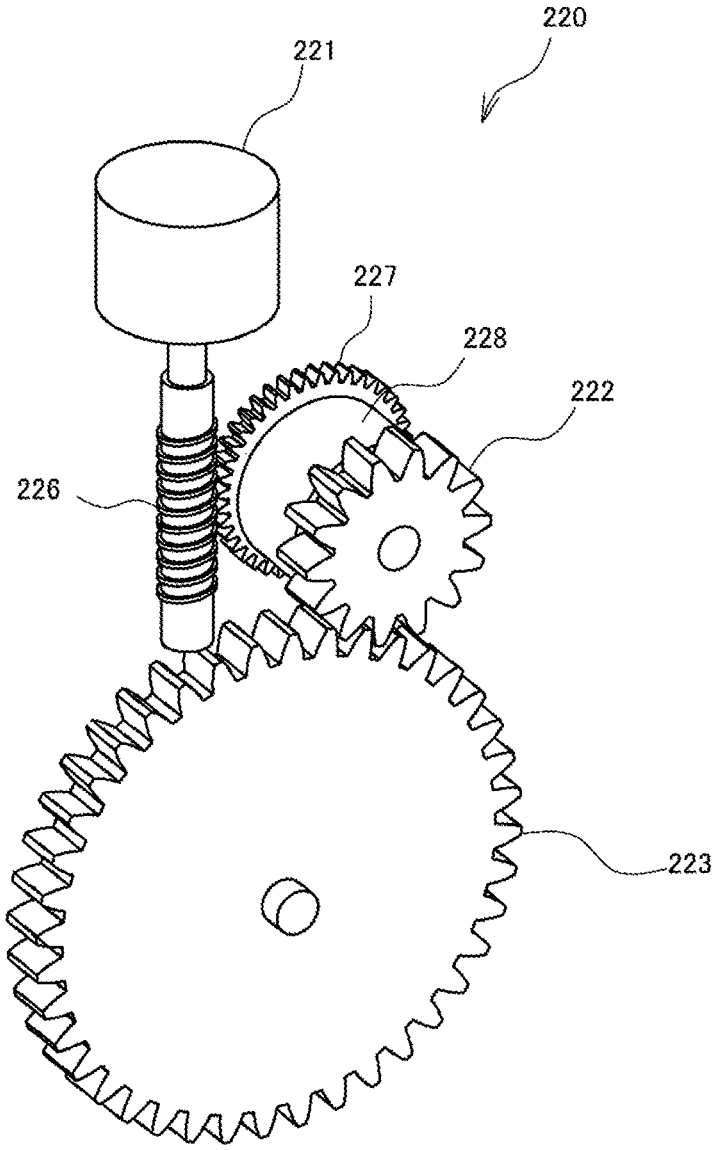
FIG. 12 illustrates a perspective view illustrating a driving device, according to a second embodiment of the present disclosure.

The driving device 220, as shown in FIG. 12, includes a driving motor 221, a worm 226 connected to a rotating shaft of the driving motor 221, a worm wheel 227 connected to the worm 226, a first gear 222 connected to the worm wheel 227, and a second gear 223 connected to the first gear 222 to wind and unwind the wire 230. Also, although not shown in the drawings, the components which form the driving device 220 are installed at the installation plate 205 while being accommodated in a driving box.

Also, as shown in FIGS. 13 and 14, one end of the wire 230 is held by and fixed to a shaft core of the second gear 223, the wire 230 is held by in order of the fixed pulley 240, the movable pulley 260, the fixed pulley 240, and the movable pulley 260 to be curved in a zigzag shape, and the other end of the wire 230 is held by and fixed to the hook 26. Accordingly, the support 210 is pulled by the wire 230 held by the movable pulley 260 in a moving-up direction with respect to the installation plate 205.

Also, the lifting device 200 includes a control device which is not shown. The control device is connected to a current sensor of the driving motor 221 or an input means which includes a moving-up button and a moving-down button installed on an outer wall surface of the refrigerator 100. Also, the control device is configured by a so-called computer which includes a CPU, a memory, a timer, an AD converter, input/output means, and the like and is configured to perform a function by executing a program stored in the memory and allowing various types of devices to cooperate. In detail, the control device performs a function of stopping driving of the driving motor 221 when the rotation number of the guide gear 290*c* detected by the encoder installed at the detection device 290 reaches a certain rotation number after a moving-up operation starts. Also, the control device performs the function of stopping driving of the driving motor 221 when a change rate of the rotation number of the guide gear 290*c* detected by the encoder installed at the detection device 290 becomes 0, in other words, the rotation number does not change during a moving-down operation.

Sequentially, an operation of the lifting device 200 according to the embodiment will be described.

First, when a user withdraws the drawer 20 from the bottom end space 31 of the refrigerator body 30 and pushes the moving-up button of the input means, the control device drives the driving motor 221 to perform a moving-up operation. In detail, as shown in FIG. 13, when the control device drives the driving motor 221, torque of the driving motor 221 is transferred in order of the worm 226, the worm wheel 227, the first gear 222, and the second gear 223 such that the second gear 223 winds the wire 230 by rotating in one direction (rightward rotation in FIG. 13). Accordingly, both movable pulleys 260 move up according to a winding amount of the wire 230 by the second gear 223, and accordingly, the support 210 to which the both movable pulleys 260 are connected is guided to the guide grooves 24 and the guide plates 25 and suspended and moved up by the wire 230.

Also, here, with moving-up of the support 210, the belt 290*b* slides along the guide rail 290*a* such that the guide gear 290*c* rotates. Also, when a rotation number of the guide gear 290*c* measured by the encoder reaches a certain rotation number, the control device determines that the support 210 reaches an uppermost position and stops driving of the driving motor 221.

Sequentially, when the user pushes the moving-down button of the input means, the control device drives the driving motor 221 to perform a moving-down operation. In detail, as shown in FIG. 14, when the control device drives the driving motor 221, torque of the driving motor 221 is transferred in order of the worm 226, the worm wheel 227, the first gear 222, and the second gear 223 such that the second gear 223 unwinds the wire 230 by rotating in the other direction (a leftward direction in FIG. 14). Accordingly, both movable pulleys 260 move down according to an unwinding amount of the wire 230 by the second gear 223, and accordingly, the support 210 to which the both movable pulleys 260 are connected is guided to the guide grooves 24 and the guide plates 25 and suspended and moved down by the wire 230. Also, here, with moving-down of the support 210, the belt 290*b* slides along the guide rail 290*a* such that the guide gear 290*c* rotates. Also, when a rotation number of the guide gear 290*c* measured by the encoder reaches a certain rotation number, the control device determines that the support 210 reaches a lowermost position and stops driving of the driving motor 221.

Also, the control device monitors a change rate of the rotation number of the guide gear 290*c* measured by the encoder at least during the moving-down operation. Also, when the support 210 is held at the installation plate 205 during the moving-down operation and moving-down of the support 210 stops, the control device stops driving of the driving motor 221. In detail, when the support 210 is held at the installation plate 205 during the moving-down operation and moving-down of the support 210 stops, the belt 290*b* does not slide on the guide rail 290*a* and rotation of the guide gear 290*c* stops. Accordingly, the rotation number of the guide gear 290*c* measured by the encoder does not change, and a change rate thereof becomes 0. Also, when the change rate of the rotation number of the guide gear 290*c* measured by the encoder is detected to be 0, the control device determines that the support 210 stops and stops driving of the driving motor 221. Since the determination of the control device is instantaneously performed after moving-down of the support 210 stops, unwinding of the wire 230 by the second gear 223 is stopped in an instant. Due thereto, laxity of the wire 230 does not occur such that the wire 230 is prevented from being deviated from each pulley.

Also, as the belt 290*b* of the detection device 290 according to the embodiment, an endless belt may be employed. In this case, the guide rail 290*a* may have a ring shape.

Also, in the detection device 290 according to the embodiment, the teeth installed at the belt 290*b* and the teeth installed at the guide gear 290*c* are allowed to engage with each other to rotate the guide gear 290*c* according to sliding of the belt 290*b*. However, the detection device 290 is not limited thereto. For example, a belt which has one flat surface and has a high frictional force may be employed as the belt 290*b*, a roller may be employed instead of the guide gear 290*c*, and the roller may be rotated according to sliding of the belt by frictional forces of the belt and the roller.

Also, in the detection device 290 according to the embodiment, the movement amount of the support 210 and the change rate thereof are detected on the basis of the rotation number of the guide gear 290*c*. However, not limited thereto, for example, a movement amount of the support 210 may be detected using a rotational speed and a lifting operation time of the guide gear 290*c*, and a change rate of the movement amount of the support 210 may be detected using a change rate of the rotational speed. In this case, the rotational speed corresponds to a related value of a transition amount in the claims.

Figure 15:
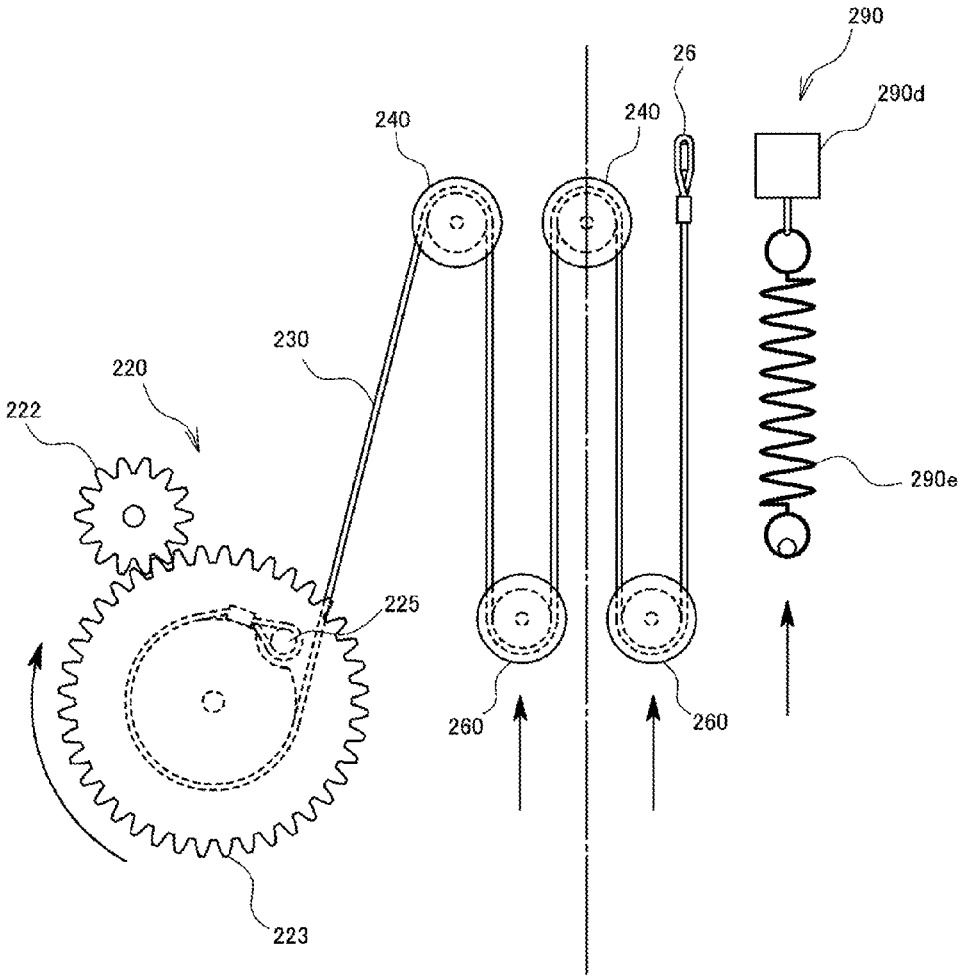
FIG. 15 illustrates a schematic diagram illustrating a support, according to a modified second embodiment of the present disclosure.

As a modified example of Embodiment 2, for example, the detection device 290 as shown in FIG. 15 may be included. Also, FIG. 15 illustrates a state in which the support 210 has moved up. The detection device 290 shown in FIG. 15 includes a tension meter 290*d* installed at a top of the installation plate 205 (in a moving-up direction) and an elastic body 290*e* elongated from the tension meter 290*d* in a moving-down direction and with one end connected to the support 210. The elastic body 290*e* is installed to remain in a state with a certain degree of tension even when the support 210 reaches an uppermost position with respect to the installation plate 205. Also, the elastic body 290*e* corresponds to a transition member (a stretchy body) in the claims and the tension meter 290*d* corresponds to a transition detection sensor in the claims.

Also, when tension of the elastic body 290*e* measured by the tension meter 290*d* installed at the detection device 290 is a certain value or less during the moving-up operation, the control device determines that the support 210 reaches the uppermost position and stops driving of the driving motor 221. Meanwhile, when tension of the elastic body 290*e* measured by the tension meter 290*d* installed at the detection device 290 is a certain value or more during the moving-down operation, the control device determines that the support 210 reaches the lowermost position and stops driving of the driving motor 221. Also, when a change rate of the tension of the elastic body 290*e* measured by the tension meter 290*d* installed at the detection device 290 is 0 during the moving-down operation, in other words, when the tension does not change, the control device determines that the support 210 has stopped and stops driving of the driving motor 221. Accordingly, the tension corresponds to a transition amount in the claims.

In this case, the elastic body 290*e* may perform a function of the transition member in the present disclosure and perform a function of supporting suspending and moving-up of the support 210 to reduce a load on the driving motor 221. Also, even when the wire 230 is cut by any cause, the support 210 is suspended by and moved down by the elastic body 290*e* and prevented from instantaneously falling.

Any elastic body which has flexibility and is elastically deformable may be used as the elastic body 290*e*. For example, a spring such as a coil spring shown in FIG. 15 and a plate spring, rubber, or the like may be used.

Also, in the modified example, tension of the elastic body 290*e* is reduced when the support 210 has moved up and increases when the support 210 has moved down. On the other hand, the tension of the elastic body 290*e* may increase when the support 210 has moved up and may be reduced when the support 210 has moved down. In this case, the detection device 290 is configured to include a tension meter 290*d* installed at a bottom of the installation plate 205 (in a moving-down direction) and an elastic body 290*e* elongated from the tension meter 290*d* in a moving-up direction and with one end connected to the support 210.

Also, although items accommodated in the box case 40 are supported by the support arms 212 of the support 210 in the embodiment, the accommodated items may be directly supported by the support arms 212 of the support 210. Also, although one lifting unit LU is installed on the rear surface of the door plate 21 of the drawer 20 in the embodiment, a plurality of such lifting units LU may be installed such that a separate item may be supported by each of the lifting units LU.

Embodiment 3

Figure 16:
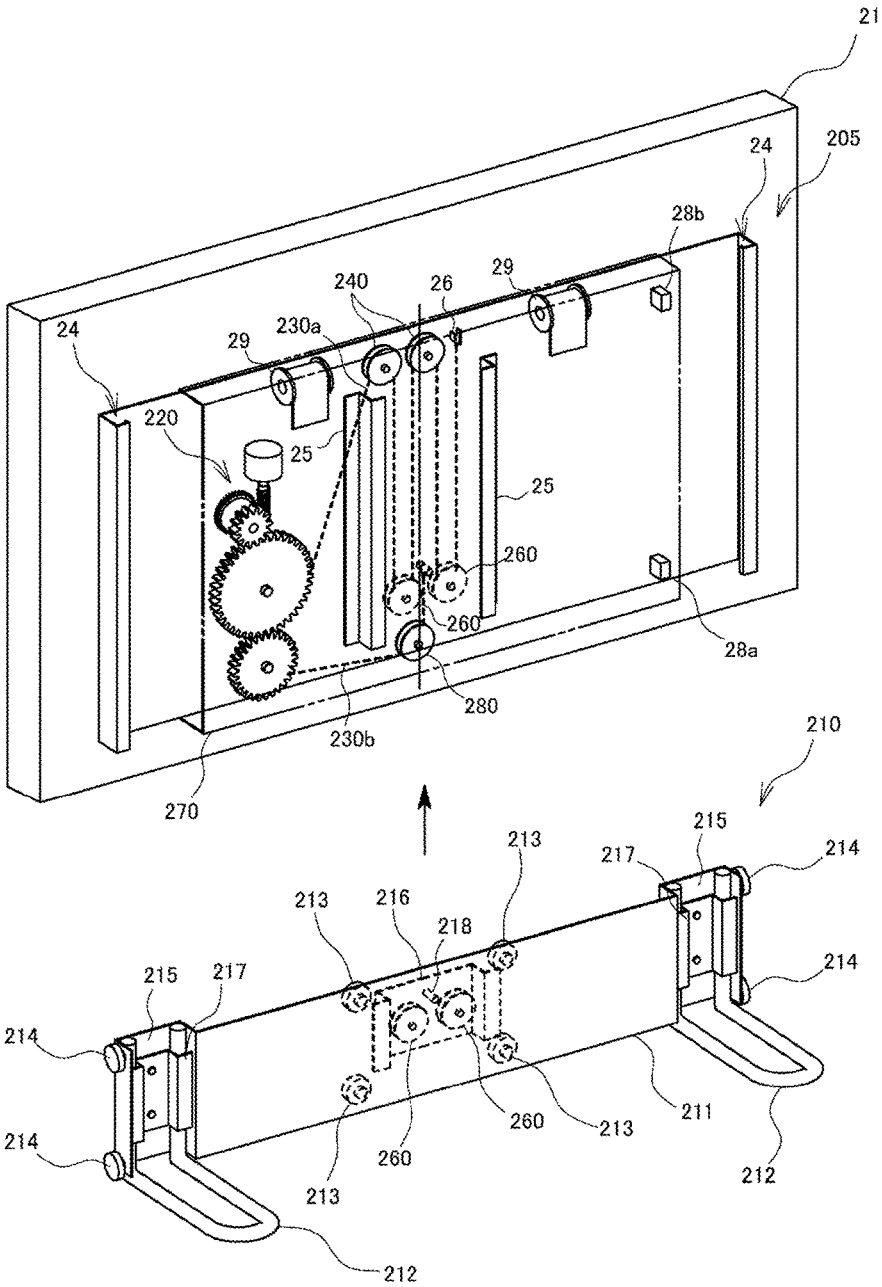
FIG. 16 illustrates a perspective view illustrating a rear surface of a door plate, according to a third embodiment of the present disclosure.

The embodiment is a modified example of the lifting unit LU of Embodiment 2. The lifting unit according to the embodiment, as shown in FIG. 16, includes an installation plate 205 installed on the rear surface of the door plate 21, a support 210 which moves up and down with respect to the installation plate 205, a driving device 220 installed at the installation plate 205, a first wire 230*a* wound and unwound by the driving device 220 to pull the support 210 upward, four fixed pulleys 240 and four movable pulleys 260 which guide the first wire 230*a*, a second wire 230*b* wound and unwound by the driving device 220 to pull the support 210 downward, and one fixed pulley 280 which guides the second wire 230*b*. In relation thereto, FIG. 16 illustrates a state in which the support 210 is removed from the installation plate 205. Also, in FIG. 16, it is assumed that the support 210 is installed at the installation plate 205, and the first wire 230*a*, the second wire 230*b*, and the movable pulleys 260 are partially shown as dotted lines to show position-relations among the first wire 230*a*, the second wire 230*b*, and the fixed and movable pulleys 240, 260, and 280.

Also, the driving device 220, the first wire 230*a*, the second wire 230*b*, the fixed and movable pulleys 240, 260, and 280, installed at the installation plate 205, are accommodated in a protection cover box 270 (shown as a double dot-and-dash line in FIG. 16) installed to cover a center of the installation plate 205. Accordingly, the driving device 220, the first wire 230*a*, the second wire 230*b*, and the fixed pulleys 240 and 280 and the movable pulleys 260, and are not exposed to be prevented from being swept by the driving device 220 to improve safety.

The installation plate 205 is formed by bending a panel and has a width narrower than a width of the door plate 21. In detail, the installation plate 205 is bent to allow both sides thereof to form guide grooves 24 which face a center in a width direction. Also, guide plates 25 are symmetrically installed at the installation plate 205, with the center in the width direction interposed therebetween. Also, at the installation plate 205, the driving device 220 is installed between the guide groove 24 and the guide plates 25 on one side, one pair of fixed pulleys 240 are installed at a top between the both guide plates 25, and the fixed pulley 280 is disposed at a bottom. Also, the fixed pulley 240 on one side, with respect to the installation plate 205, is disposed over a central line which divides the support 210 in a direction perpendicular to a lifting direction (that is, a width direction of the installation plate 205).

Also, at the installation plate 205, a hook 26 is installed to be in parallel to the fixed pulley 240 on one side, and a lower position sensor 28*a* which detects a position of the support 210 which has moved down near a bottom end of the installation plate 205 and an upper position sensor 28*b* which detects a position of the support 210 which has moved up near a top end of the installation plate 205 are installed to face the guide groove 24 on one side. Also, one pair of support devices 29 are arranged at the top of the installation plate 205 to be linearly symmetrical with the central line. Also, long plate springs are wound on the pair of support devices 29 to be stretched. Here, one end of each of both plate springs is fixed to the support 210 and constantly pulls the support 210 upward to keep balance of an inclination of the support 210.

The support 210 includes a support plate 211 which moves up and down along the installation plate 205 and a pair of support arms 212 which are fixed to the support plate 211 and support a box case 40 at a bottom surface.

The support plate 211 is formed by bending a panel and has a width slightly narrower than the width of the installation plate 205. In detail, the support plate 211 has a shape in which a central part follows an inner surface of the protection cover box 270 and both sides are bent to form concave grooves 215 for installing the support arms 212. Also, a support box 216 is installed at the central part of the support plate 211 on a surface which faces the installation plate 205, and one pair of first guide rollers 213 are installed with gaps from side surfaces of the support box 216. Also, the pair of first guide rollers 213 guide the support 210 with the guide plates 25 inserted into the gaps from the support box 216 as guides. Also, one pair of second guide rollers 214 are installed on both sides of the support plate 211, on sidewalls which face the guide grooves 24 of the concave grooves 215.

Also, one pair of movable pulleys 260 and a shaft body 218 are installed in the support box 216 of the support plate 211. Also, the pair of movable pulleys 260, with respect to the installation plate 205, are arranged to be linearly symmetrical with a central line which divides in a direction perpendicular to a lifting direction of the support 210 (that is, a width direction of the installation plate 205). Also, the shaft body 218 is disposed on the central line. The support box 216 has a width which fits between both the guide plates 25 such that the support 210 may easily move up and down along the installation plate 205 without rattling.

Figure 18:
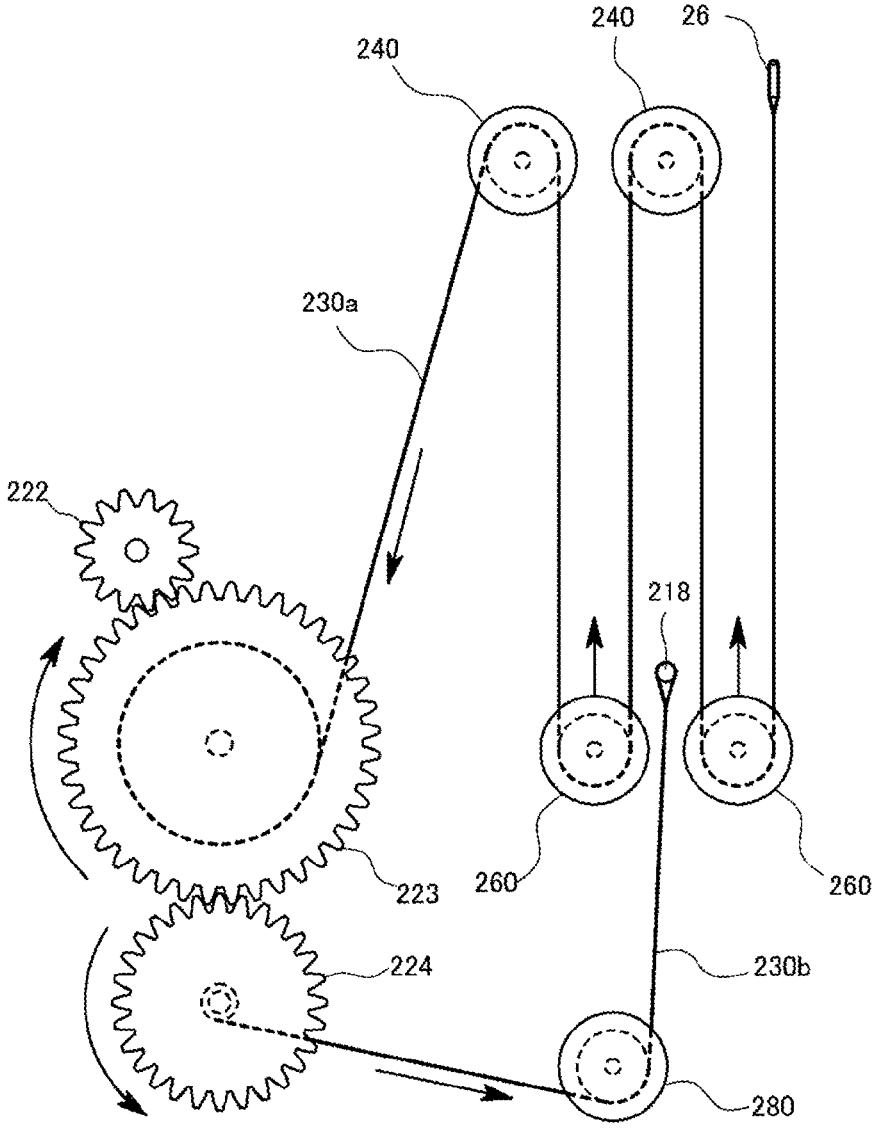
FIG. 18 illustrates a configuration diagram illustrating a movement during a moving-up operation of a support, according to a third embodiment of the present disclosure.
Figure 19:
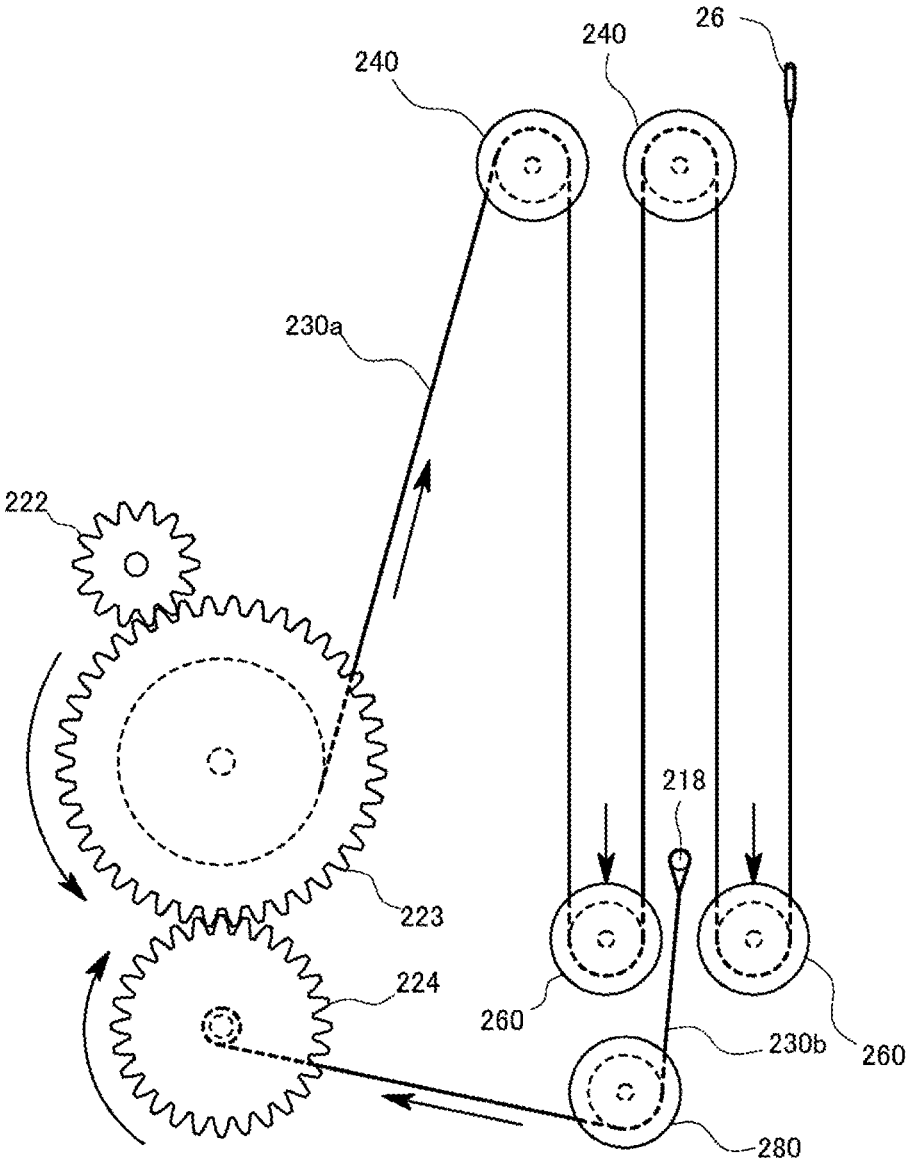
FIG. 19 illustrates a configuration diagram illustrating a movement during a moving-down operation of the support, according to a third embodiment of the present disclosure.

Accordingly, as shown in FIGS. 18 and 19, the two fixed pulleys 240 installed at the top of the installation plate 205 and the pair of movable pulleys 260 installed at the support plate 211 guide the first wire 230*a* connected to the driving device 220, and the one fixed pulley 280 installed at the bottom of the installation plate 205 guides the second wire 230*b* connected to the driving device 220.

Figure 17:
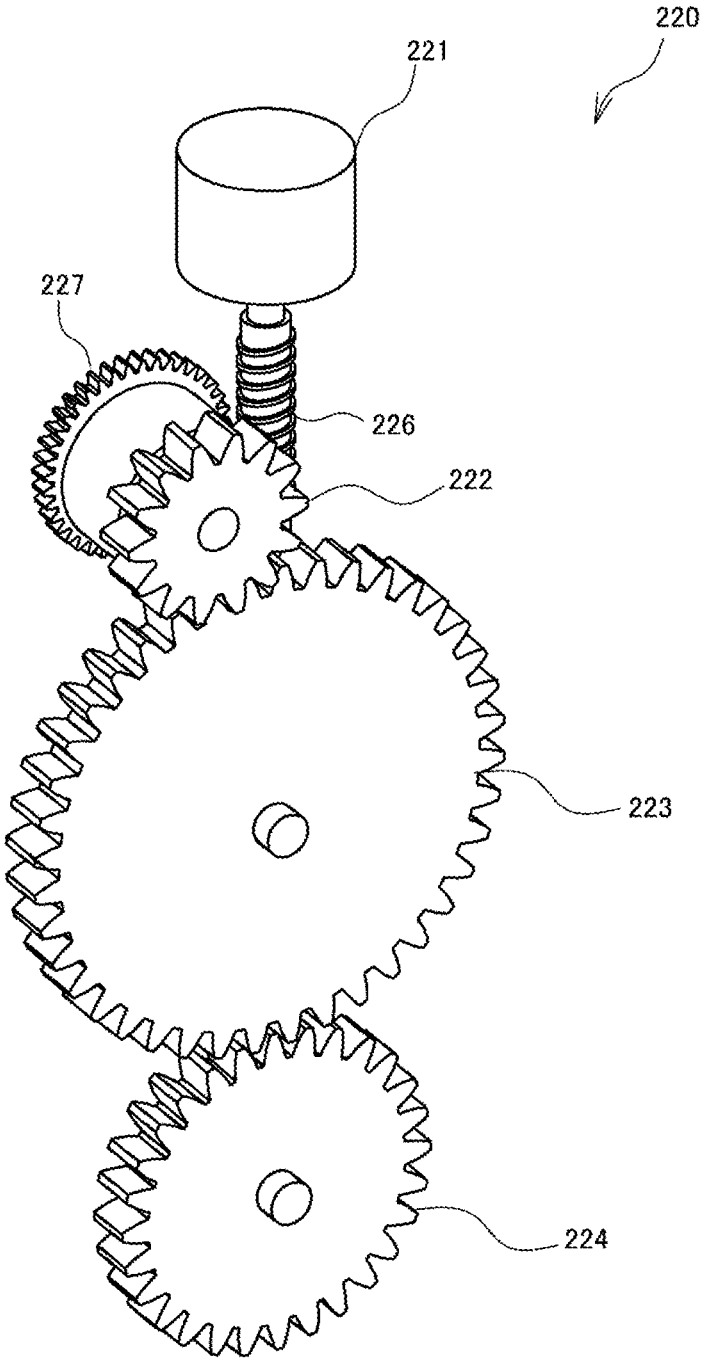
FIG. 17 illustrates a perspective view illustrating a driving device, according to a third embodiment of the present disclosure.

The driving device 220, as shown in FIG. 17, includes a driving motor 221, a worm 226 connected to a rotating shaft of the driving motor 221, a worm wheel 227 connected to the worm 226, a first gear 222 connected to the worm wheel 227, a second gear 223 connected to the first gear 222 to wind and unwind the first wire 230*a*, and a third gear 224 connected to the second gear 223 to wind and unwind the second wire 230*b*. Also, the driving motor 221 includes a current sensor (not shown) which detects an overload current thereof. Also, the second gear 223 corresponds to a first rotating body in the claims, the third gear 224 corresponds to a second rotating body in the claims, and the current sensor corresponds to a detection device in the claims. Also, although not shown in the drawings, the components which form the driving device 220 are installed at the installation plate 205 while being accommodated in a driving box.

The second gear 223 and the third gear 224 are configured to rotate reversely from each other. Accordingly, the third gear 224 is configured to wind the second wire 230*b* when the second gear 223 unwinds the first wire 230*a*. Here, an unwinding amount of the second gear 223 is four times a winding amount of the third gear 224. Also, on the other hand, the third gear 224 is configured to unwind the second wire 230*b* when the second gear 223 winds the first wire 230*a*. Here, a winding amount of the second gear 223 is four times an unwinding amount of the third gear 224. Also, to allow the unwinding amounts and the winding amounts of the second gear 223 and the third gear 224 to be as described above, it is necessary to design the both the second and the third gears 223 and 224 on the basis of a gear ratio between the second gear 223 and the third gear 224, radii of shaft cores of the second gear 223 and the third gear 224, which winds the wires, and the number of movable pulleys which guides both the first and second wires 230*a* and 230*b*. For example, when the gear ratio of the second gear 223 and the third gear 224 is 1, the first wire 230*a* is guided by two movable pulleys, and the second wire 230*b* is not guided by movable pulleys, the radius of the shaft core of the third gear 224 is designed to have a length of ¼ of the radius of the shaft core of the second gear 223.

Also, as shown in FIGS. 18 and 19, one end of the first wire 230*a* is held by and fixed to the shaft core of the second gear 223, the first wire 230*a* is held by in order of the fixed pulley 240, the movable pulley 260, the fixed pulley 240, and the movable pulley 260 to be curved in a zigzag shape, and the other end of the first wire 230*a* is held by and fixed to the hook 26. Accordingly, the support 210 has been pulled by the first wire 230*a* held by the movable pulley 260 in a moving-up direction with respect to the installation plate 205. Also, one end of the second wire 230*b* is held by and fixed to the shaft core of the third gear 224, the second wire 230*b* is held by the fixed pulley 280 to be curved in an L shape, and the other end of the second wire 230*b* is fixed while being held by the shaft body 218. Accordingly, the support 210 has been pulled by the second wire 230*b* held by the shaft body 218 in a moving-down direction with respect to the installation plate 205.

Also, the lifting device 200 includes a control device which is not shown. The control device is connected to a current sensor of the driving motor 221 or an input means which includes a moving-up button and a moving-down button installed on an outer wall surface of the refrigerator 100. Also, the control device is configured by a so-called computer which includes a CPU, a memory, AD/DA converters, input/output means, and the like and is configured to perform a function by executing a program stored in the memory and allowing various types of devices to cooperate. In detail, when an overload current of a certain level or more is detected by the current sensor installed at the driving motor 221 of the driving device 220, the control device stops driving of the driving motor 221.

Sequentially, an operation of the lifting device 200 according to the embodiment will be described.

First, when a user withdraws the drawer 20 from the bottom end space 31 of the refrigerator body 30 and pushes the moving-up button of the input means, the control device drives the both driving motors 221 to perform a moving-up operation. In detail, as shown in FIG. 18, when the control device drives the driving motor 221, torque of the driving motor 221 is transferred in order of the worm 226, the worm wheel 227, the first gear 222, the second gear 223, and the third gear 224 such that the second gear 223 winds the first wire 230*a* by rotating in one direction (rightward rotation in FIG. 18) and simultaneously the third gear 224 unwinds the second wire 230*b* by rotating in the other direction (a leftward direction in FIG. 18). Accordingly, the both movable pulleys 260 are lifted according to a winding amount of the first wire 230*a* by the second gear 223, and accordingly, the support 210 to which the both movable pulleys 260 are connected is guided to the guide grooves 24 and the guide plates 25 and suspended and moved up by the first wire 230*a*. Also, when a detection signal of the support 210 is received from the upper position sensor 28*b* installed at the installation plate 205, the control device stops driving of the both driving motors 221.

Sequentially, when the user pushes the moving-down button of the input means, the control device drives the both driving motors 221 to perform a moving-down operation. In detail, as shown in FIG. 19, when the control device drives the driving motor 221, torque of the driving motor 221 is transferred in order of the worm 226, the worm wheel 227, the first gear 222, the second gear 223, and the third gear 224 such that the second gear 223 unwinds the first wire 230*a* by rotating in the other direction (a leftward direction in FIG. 19) and simultaneously the third gear 224 winds the second wire 230*b* by rotating in one direction (rightward rotation in FIG. 19). Accordingly, the both movable pulleys 260 move down according to an unwinding amount of the first wire 230*a* by the second gear 223, and accordingly, the support 210 to which the both movable pulleys 260 are connected is guided to the guide grooves 24 and the guide plates 25 and suspended and moved down by the first wire 230*a*. Also, when a detection signal of the support 210 is received from the lower position sensor 28*a* installed at the installation plate 205, the control device stops driving of the both driving motors 221.

Also, the control device monitors an overload current of the driving motor 221 at all the time at least during the moving-down operation. Also, when the support 210 is held at the installation plate 205 during the moving-down operation and moving-down of the support 210 stops, the control device stops driving of the driving motor 221. In detail, when the support 210 is held at the installation plate 205 during the moving-down operation and moving-down of the support 210 stops, since the driving motor 221 operates right after that, it continues that the first wire 230*a* is unwound by the second gear 223 and the second wire 230*b* is wound by the third gear 224. Accordingly, even though moving-down of the support 210 has stopped, the second wire 230*b* is wound by the third gear 224 and excessive tension occurs at the second wire 230*b*. Also, since the driving motor 221 rotates the third gear 224 to wind the second wire 230*b*, an overload current is generated at the driving motor 221 and is sensed by the current sensor. When the overload current is sensed by the current sensor, the control device determines that a failure occurs in moving-down of the support 210 and stops driving of the driving motor 221. Also, since the determination of the control device is instantaneously performed after moving-down of the support 210 stops, the unwinding of the first wire 230*a* by the second gear 223 is stopped in an instant. Due thereto, laxity of the first wire 230*a* does not occur such that the first wire 230*a* is prevented from being deviated from each pulley.

Figure 20A:
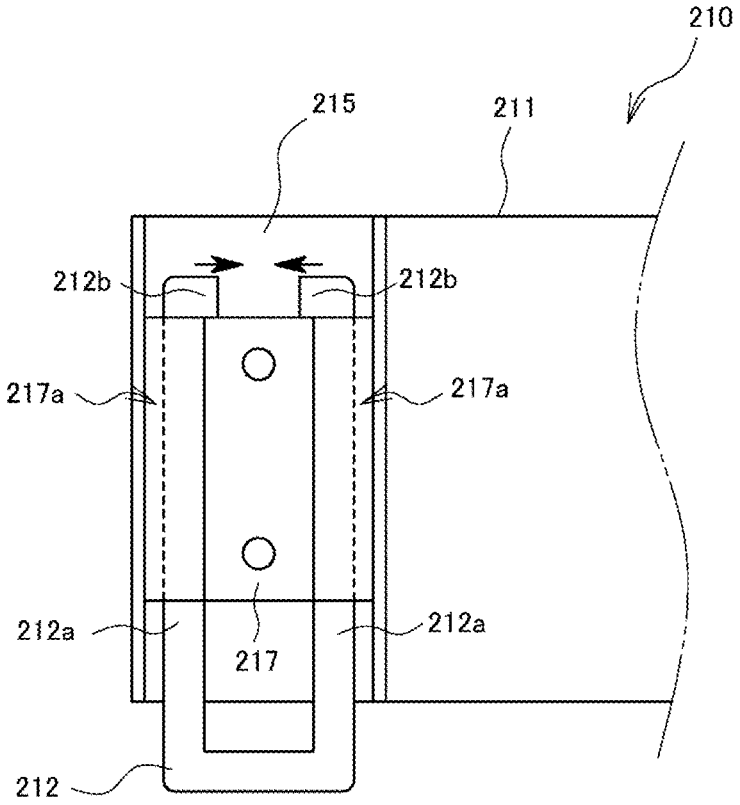
FIGS. 20A and 20B illustrate schematic diagrams illustrating a sequence of attaching and detaching a support arm to or from a support, according to a modified third embodiment of the present disclosure.
Figure 20B:
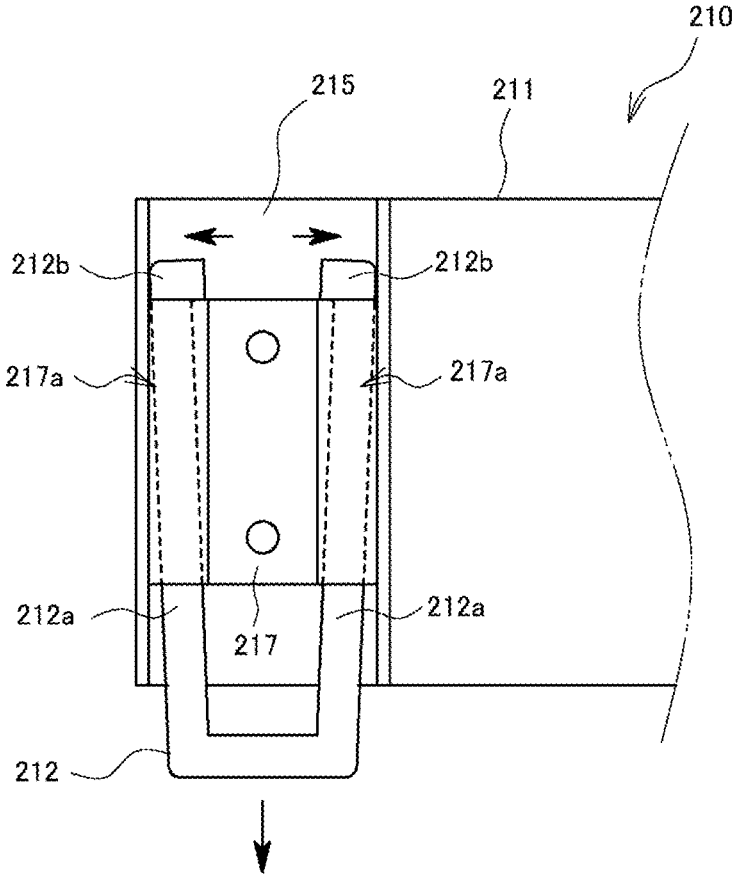

A modified example of the support arm 212 in the embodiment is illustrated in FIGS. 20A and 20B. Also, the support arm 212 shown in FIG. 20A has a shape in which a metal rod is bent such that a pair of L-shaped bar bodies 212*a* arranged in parallel are connected at one ends thereof like the embodiment. Accordingly, the entire support arm 212 has elasticity. Also, holding pieces 212*b* which elongate from the other ends of the pair of bar bodies 212*a* in directions opposite to each other are installed at the support arm 212. Also, the support arm 212 is fixed by inserting the pair of bar bodies 212*a* from the other ends into a pair of long holes 217*a* formed by the concave grooves 215 and the fixing plate 217 and holding the holding pieces 212*b* at a top end of the fixing plate 217 by using elasticity which faces an inside of the pair of bar bodies 212*a*. Accordingly, when the support arm 212 is removed from the support 210, as shown in FIG. 20B, the pair of bar bodies 212*a* of the support arm 212 are extended outward against the elasticity. According thereto, the holding pieces 212*b* are removed from the top end of the fixing plate 217 and pulled out from the pair of long holes 217*a*. The support arm 212 having the above-described configuration may be easily attached to or detached from the support 210. Also, although the elasticity which faces the inside of the pair of bar bodies 212*a* is used in the support arm 212 in the embodiment, elasticity which faces outside may be used. In this case, the holding pieces 212*b* elongated from the other ends of the pair of bar bodies 212*a* in directions opposite to each other may be installed at the support arm 212, and also, holding holes and the like by which the holding pieces 212*b* are held are installed at a side wall of the concave groove 215 of the support 210.

Figure 21:
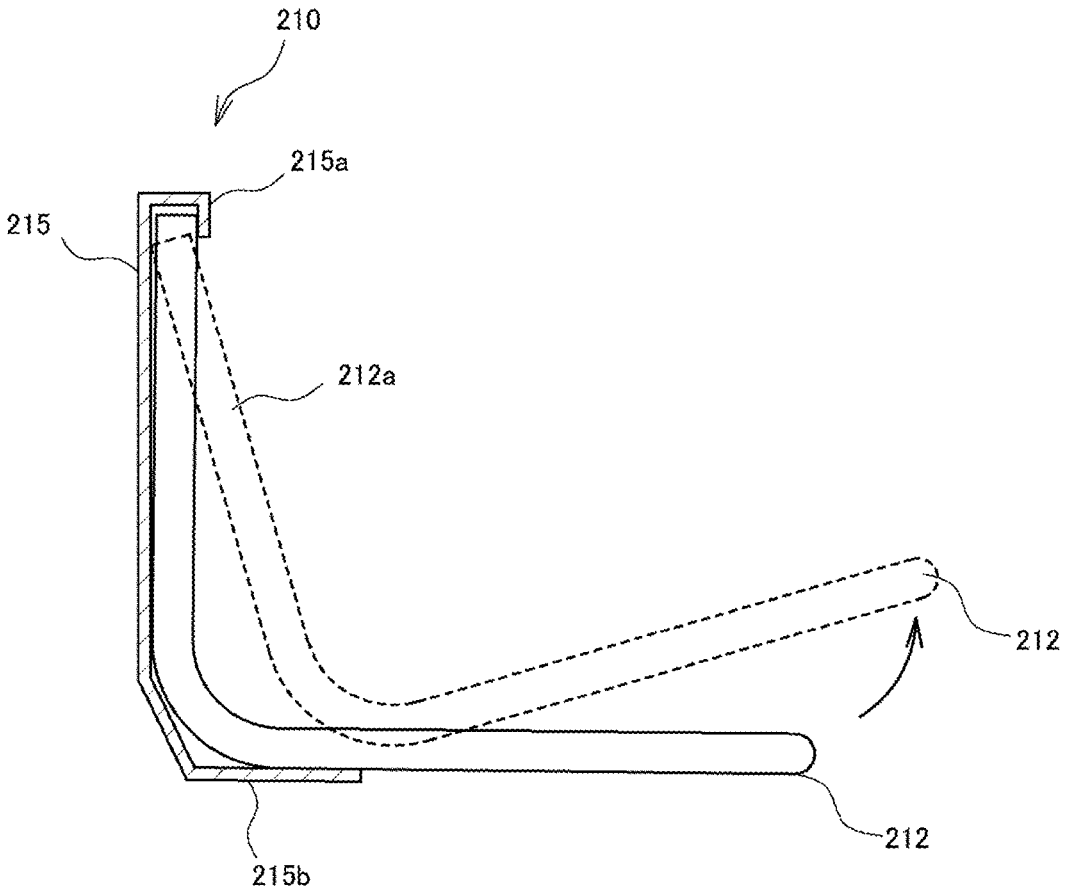
FIG. 21 illustrates a schematic diagram illustrating an operation of attaching and detaching a support arm to or from a support, according to a modified third embodiment of the present disclosure.

Also, a modified example of an attachment/detachment structure of the support arms 212 in the embodiment is illustrated in FIG. 21. In the embodiment, the support arm 212 like the embodiment is attached to or detached from a support 210 having a structure different from that of the embodiment. Also, a cross section of the support 210 is shown in FIG. 21 to specify the different structure. In the support 210 according to the embodiment, a holding piece 215*a* having a groove shape with an upper side bent to be open in a moving-down direction is installed and simultaneously a loading stand 215*b* with a lower side bent to face the holding piece 215*a* is installed. Also, when the support arm 212 is installed at the support 210, a top end of the support arm 212 is inserted into a groove of the holding piece 215*a* and the support arm 212 is loaded on the loading stand 215*b*. Accordingly, while the support arm 212 is loaded on the loading stand 215*b*, the top end thereof is held by the holding piece 215*a* and fixed to the support 210. Also, when the support arm 212 is removed from the support 210, a front end of the support arm 212 is pulled forward (a right side in FIG. 21) to pull the top end out of the holding piece 215*a*. In this form, it is unnecessary to install the fixing plate 217 and it is possible to attach or detach the support arm 212 to or from the support 210 without using a tool. Also, in this case, when the pair of bar bodies 212*a* are allowed to pressurize the sidewall of the concave groove 215 by using elasticity which faces outside of the pair of bar bodies 212*a* in the support arm 212, the support arm 212 may be more stably installed at the support 210.

Also, elastic bodies such as springs and the like may be installed at parts of the first wire 230*a* or the second wire 230*b* in the embodiment. In this configuration, since the elastic body absorbs laxity which occurs at the first wire 230*a* or the second wire 230*b*, laxity may not easily occur at the first wire 230*a* or the second wire 230*b*. Due to this, it is preferable to install the elastic body to generate tension to a certain degree while the first wire 230*a* or the second wire 230*b* is installed at the lifting device 200.

Also, in the embodiment, a configuration of installing a driving device and the like on one side of the central line at the installation plate 205 is employed. However, it is possible to employ a configuration of installing a driving device and the like on both sides of the central line to be linearly symmetrical with respect to the central line. In this case, the third gear 224 may be installed at the both driving devices 220 and simultaneously the second wire 230*b* connected to the third gear 224 may be held by the support 210. Accordingly, a device which emergently stops the driving device 220 in an abnormal moving-down operation may be built in the both driving devices 220.

Also, although the two fixed pulleys 240 and the two movable pulleys 260 are employed as pulleys which guide the first wire 230*a* in the embodiment, the number of fixed pulleys 240 or movable pulleys 260 is not limited thereto and may be any number capable of holding the first wire 230*a* to lift the support 210 with respect to the installation plate 205. For example, the fixed pulleys 240 may not be installed and one movable pulley 260 is installed at the support 210 may guide the first wire 230*a*. Also, likewise, the number of pulleys which guide the second wire 230*b* is not particularly limited.

Also, although one fixed pulley 280 is used as a pulley which guides the second wire 230*b* in the embodiment, a movable pulley may be used and also the numbers of fixed pulleys and movable pulleys are not particularly limited. When a movable pulley is used, the movable pulley is installed at the support 210 like the movable pulleys which guide the first wire 230*a*. Also, as a case in which a movable pulley is necessary as a pulley which guides the second wire 230*b*, a case of installing a damper to prevent the support 210 from rapidly falling due to cut and the like of the first wire 230*a* may be considered. In detail, a rotary damper which generates resistance when moving in a moving-down direction is installed at the support 210 and a rack gear which engages with the rotary damper is installed at the installation plate 205. In this configuration, a falling speed of the support 210 is limited by an effect of the rotary damper such that rapid falling of the support 210 may be prevented. However, since it is necessary to apply a force which resists the rotary damper to the third gear 224, movable pulleys which guide the second wire 230*b* are installed at the support 210 to reduce the force.

Also, in the embodiment, even when the support 210 is not held, a configuration of pulling the support 210 by using the second wire 230*b* is employed and the support 210 is pulled in any one of a moving-up direction and a moving-down direction such that rattling of the support 210 with respect to the installation plate 205 is suppressed. However, when the support 210 is not held, the configuration of pulling the support 210 by using the second wire 230*b* is unnecessary and the support 210 may be configured to be pulled by the second wire 230*b* when the support 210 is held during a moving-down operation. However, since there is a possibility in which the second wire 230*b* is deviated from the pulleys in a relaxed state, a configuration of pulling the support 210 by using the second wire 230*b* to allow the second wire 230*b* to remain in a tight state may be employed.

Also, although the current sensor which detects an overload current at the driving motor is used as the detection device and a failure in moving-down of the support 210 during the moving-down operation is detected in the embodiment, an encoder which detects a rotation number or a rotational speed may be connected to the driving motor 221 and may be used as the detection device.

Embodiment 4

Figure 22:
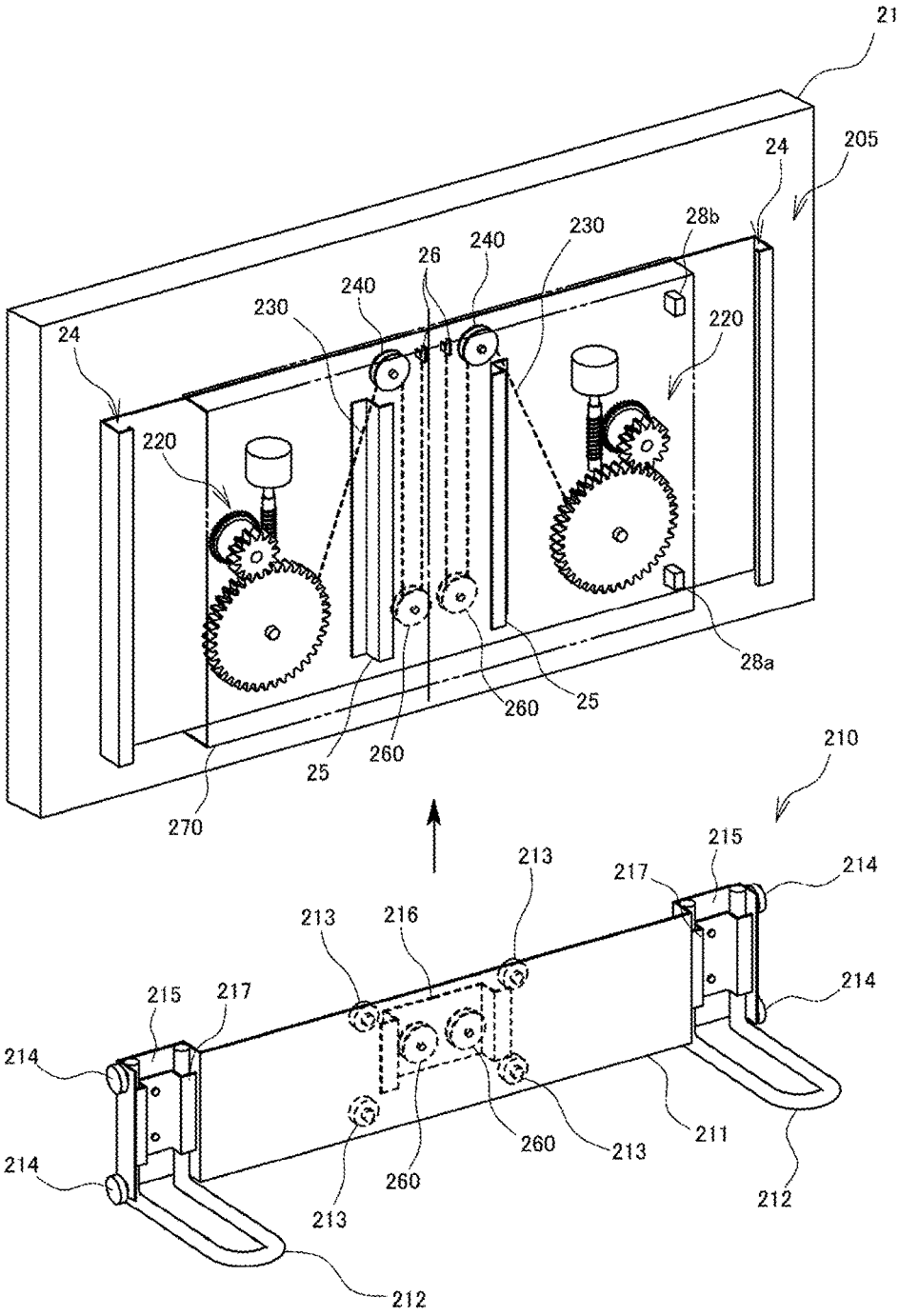
FIG. 22 illustrates a perspective view illustrating a rear surface of a door plate, according to a fourth embodiment of the present disclosure.

The embodiment is a modified example of the lifting unit LU of Embodiment 2. A lifting unit LU according to the embodiment, as shown in FIG. 22, includes an installation plate 205 installed on the rear surface of the door plate 21, a support 210 which moves up and down with respect to the installation plate 205, a pair of driving devices 220 installed at the installation plate 205, wires 230 which transfer power of the driving devices 220 to the support 210, and two fixed pulleys 240 and two movable 260 which guide each of the wires 230. In relation thereto, FIG. 22 illustrates a state in which the support 210 is removed from the installation plate 205. Also, in FIG. 22, it is assumed that the support 210 is installed at the installation plate 205, and each of the wires 230 and the movable pulley 260 are shown as dotted lines to show position-relations among each of the wires 230 and the fixed pulleys 240 and the movable pulley 260. Also, each of the driving devices 220 has the same configuration as that of the driving device 220 according to Embodiment 2.

Also, the driving devices 220, the wires 230, and the fixed and movable pulleys 240 and 260 installed at the installation plate 205 are accommodated in a protection cover box 270 (shown as a double dot-and-dash line in FIG. 22) installed to cover a center of the installation plate 205. Accordingly, the driving devices 220, the wires 230, and the fixed and movable pulleys 240 and 260 are not exposed to be prevented from being swept by the driving devices 220 to improve safety.

The installation plate 205 is formed by bending a panel and has a width narrower than a width of the door plate 21. In detail, the installation plate 205 is bent to allow both sides thereof to form guide grooves 24 which face a center in a width direction. Also, guide plates 25 are symmetrically installed at the installation plate 205, with the center in the width direction interposed therebetween. Also, at the installation plate 205, the driving device 220 is installed between the guide groove 24 and the guide plates 25, and the fixed pulleys 240 are installed at tops of the both guide plates 25. Also, the pair of driving devices 220 and the pair of fixed pulleys 240 are arranged at the installation plate 205 to be linearly symmetrical with a central line (shown as a dot-and-dash line in FIG. 22), which divides the support 210 in a direction perpendicular to a lifting direction (that is, a width direction of the installation plate 205), interposed therebetween. Also, at the installation plate 205, one pair of hooks 26 are installed between the both fixed pulleys 240, and a lower position sensor 28*a* which detects a position of the support 210 which has moved down near a bottom end of the installation plate 205 and an upper position sensor 28*b* which detects a position of the support 210 which has moved up near a top end of the installation plate 205 are installed to face the guide groove 24 on one side. Also, at the installation plate 205, the guide grooves 24, the guide plates 25, and the hooks 26 are also arranged to be linearly symmetrical with the central line therebetween.

The support 210 includes a support plate 211 which moves up and down along the installation plate 205 and a pair of support arms 212 which are fixed to the support plate 211 and support a box case 40 at a bottom surface.

The support plate 211 is formed by bending a panel and has a width slightly narrower than the width of the installation plate 205. In detail, the support plate 211 has a shape in which a central part follows an inner surface of the protection cover box 270 and both sides are bent to form concave grooves 215 for installing the support arms 212. Also, a support box 216 is installed at the central part of the support plate 211 on a surface which faces the installation plate 205, and one pair of first guide rollers 213 are installed with gaps from side surfaces of the support box 216. Also, the pair of first guide rollers 213 guide the support 210 with the guide plates 25 inserted into the gaps from the support box 216 as guides. Also, one pair of second guide rollers 214 are installed on both sides of the support plate 211, on sidewalls which face the guide grooves 24 of the concave grooves 215.

Also, one pair of movable pulleys 260 are installed in the support box 216 of the support plate 211. Also, the pair of movable pulleys 260 are arranged at the installation plate 205 to be linearly symmetrical with a central line which divides in a direction perpendicular to a lifting direction of the support 210 (that is, a width direction of the installation plate) (refer to FIGS. 23 and 24). Also, the support box 216 has a width which fits between both the guide plates 25 such that the support 210 may easily move up and down along the installation plate 205 without rattling.

Figure 23:
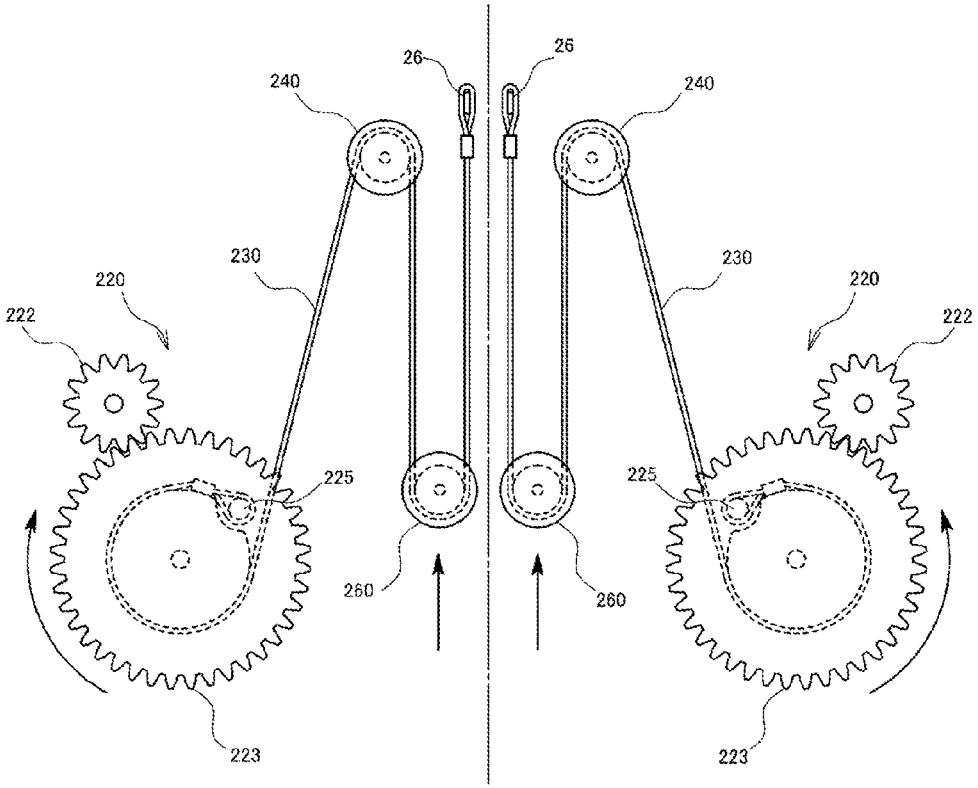
FIG. 23 illustrates a configuration diagram illustrating a movement during a moving-up operation of a support, according to a fourth embodiment of the present disclosure.
Figure 24:
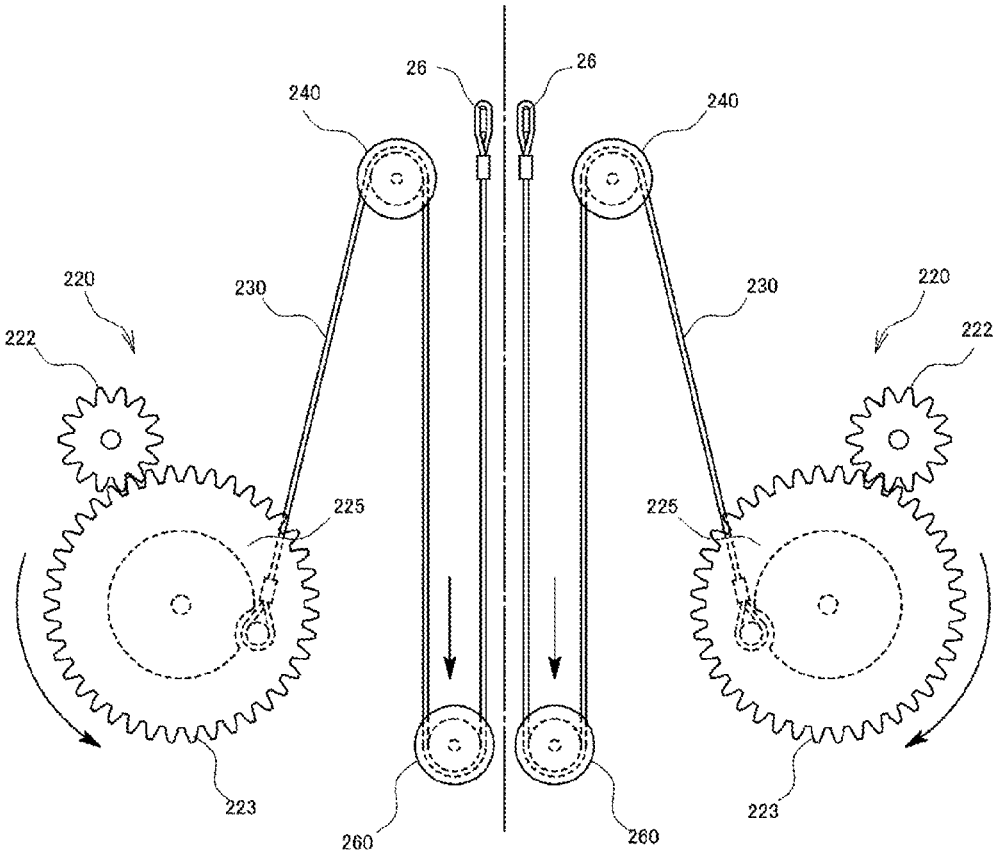
FIG. 24 illustrates a configuration diagram illustrating a movement during a moving-down operation of the support, according to a fourth embodiment of the present disclosure.

Accordingly, as shown in FIGS. 23 and 24, all the pair of fixed pulleys 240 installed at the installation plate 205 and the pair of movable pulleys 260 installed at the support plate 211 are arranged to be linearly symmetrical with the central line which divides in the direction perpendicular to the lifting direction of the support 210 therebetween. Also, the fixed pulley 240 and the movable pulley 260 positioned on one side of the central line guide the wire 230 connected to the driving device 220 positioned likewise on one side, and the fixed pulley 240 and the movable pulley 260 positioned on the other side guide the wire 230 connected to the driving device 220 positioned likewise on the other side.

Also, although not shown in the drawings, the support plate 211 includes a plurality of reducing holes within a range of maintaining strength thereof, to reduce a weight thereof Also, the installation plate 205 also includes a plurality of reducing holes within a range of maintaining strength thereof.

The driving device 220 includes the same configuration as that of the driving device 220 according to Embodiment 2 which includes a driving motor 221, a worm 226 connected to a rotating shaft of the driving motor 221, a worm wheel 227 connected to the worm 226, a first gear 222 connected to a rotating shaft of the worm wheel 227 through an encoder 228, and a second gear 223 connected to the first gear 222 to wind and unwind the wire 230. The encoder 228 measures a rotation number, a rotational speed, and the like of the driving motor 221. Also, the second gear 223 corresponds to a winding and unwinding device in the claims, and the encoder 228 corresponds to a first detection device and a second detection device in the claims. Also, although not shown in the drawings, the members which form the driving device 220 are installed at the installation plate 205 while being accommodated in a driving box.

Also, as shown in FIGS. 23 and 24, one end of each of the wires 230 is held by and fixed to the detection shaft 225 installed at the second gear 223, each of the wires 230 is held by in order of the fixed pulley 240 and the movable pulley 260 to be curved in an N shape, and the other end of each of the wires 230 is held by and fixed to the hook 26. Accordingly, the support 210 is suspended from the installation plate 205 by the wire 230 held by the movable pulley 260.

Also, the lifting device 200 includes a control device which is not shown. The control device is connected to the encoders 228 of the both driving devices 220 or an input means which includes a moving-up button and a moving-down button installed on an outer wall surface of the refrigerator 100. Also, the control device is configured by a so-called computer which includes a CPU, a memory, AD/DA converters, input/output means, and the like and is configured to perform a function by executing a program stored in the memory and allowing various types of devices to cooperate.

In detail, the control device obtains the rotation numbers and the rotational speeds of the driving motors 221 connected to the encoders 228 installed at the driving devices 220 from the encoders 228 and calculates winding amounts or unwinding amounts of the wires 230 by the driving motors 221 from the rotation numbers of the both driving motors 221. Subsequently, the winding amounts or the unwinding amounts of the wires 230 of the both driving motors 221 are compared, and the rotational speed of the driving motor 221 on one side in which the winding amount or unwinding amount of the wire 230 is smaller and an upper limit of the rotational speed of the driving motor 221 previously recorded in the memory are compared. Also, the rotational speed of the driving motor 221 on the other side is controlled to be decreased when the rotational speed of the driving motor 221 on one side exceeds the upper limit. The rotational speed of the driving motor 221 on one side is controlled to be increased when the rotational speed of the driving motor 221 on one side does not exceed the upper limit. Accordingly, the winding amounts or the unwinding amounts of the wires 230 by the both driving motors 221 are approximately maintained to be equal. Also, in the embodiment, "the winding amount" or "the unwinding amount" corresponds to "an operation amount" in the claims and "the rotational speed of the driving motor" corresponds to "an operational speed".

Sequentially, an operation of the lifting device 200 according to the embodiment will be described.

First, when a user withdraws the drawer 20 from the bottom end space 31 of the refrigerator body 30 and pushes the moving-up button of the input means, the control device drives the both driving motors 221 to perform a moving-up operation. In detail, as shown in FIG. 23, when the control device drives the both driving motors 221, the both driving motors 221 rotate reversely to each other. Accordingly, torque of each of the driving motors 221 is sequentially transferred to the worm 226, the worm wheel 227, the first gear 222, and the second gear 223 such that the second gear 223 on one side (a left side in FIG. 23) rotates in one rotation direction (rightward rotation in FIG. 23) to wind the wire 230 and simultaneously the second gear 223 on the other side (a right side in FIG. 23) rotates in the other rotation direction (leftward rotation in FIG. 23) to wind the wire 230. Accordingly, the both movable pulleys 260 are lifted according to the winding amounts of the wires 230 by the both second gears 223, and accordingly, the support 210 to which the both movable pulleys 260 are connected is guided to the guide grooves 24 and the guide plates 25 and suspended and moved up by the wires 230. Also, when a detection signal of the support 210 is received from the upper position sensor **28*b* installed at the installation plate 205, the control device stops driving of the both driving motors 221**.

Sequentially, when the user pushes the moving-down button of the input means, the control device drives the both driving motors 221 to perform a moving-down operation. In detail, as shown in FIG. 24, when the control device drives the both driving motors 221, the both driving motors 221 rotate reversely to each other. Accordingly, torque of each of the driving motors 221 is sequentially transferred to the worm 226, the worm wheel 227, the first gear 222, and the second gear 223 such that the second gear 223 on one side (a left side in FIG. 24) rotates in the other rotation direction (leftward rotation in FIG. 24) to unwind the wire 230 and simultaneously the second gear 223 on the other side (a right side in FIG. 24) rotates in one rotation direction (rightward rotation in FIG. 24) to unwind the wire 230. Accordingly, the both movable pulleys 260 move down according to the unwinding amounts of the wires 230 by the both second gears 223, and accordingly, the support 210 to which the both movable pulleys 260 are connected is guided to the guide grooves 24 and the guide plates 25 and suspended and moved down by the wires 230. Also, when a detection signal of the support 210 is received from the lower position sensor **28*a* installed at the installation plate 205, the control device stops driving of the both driving motors 221**.

Also, the control device obtains rotation numbers and rotational speeds of the driving motors 221 during the moving-up operation and the moving-down operation from the encoders 228 and calculates the winding amounts or the unwinding amounts of the wires 230 by the driving motors 221 from the rotation numbers thereof. When the winding amounts or the unwinding amounts of the both driving motors 221 are not identical, the winding amounts or the unwinding amounts of the wires 230 by the both driving motors 221 are controlled as described above to be approximately identical to each other. Accordingly, the support 210 is prevented from being tilted such that the support 210 is easily lifted with respect to the installation plate 205.

Modified examples of the driving devices 220 according to the embodiment, in which numbers, positions, or the like of the wires 230 and the pulleys fixed and movable 240 and 260 are changed, are illustrated in FIGS. 25A to 26B. Also, in FIGS. 25A to 26B, shaft cores on which the wires 230 of the second gear 223 are wound are illustrated with respect to the driving devices 220. Also, with respect to the fixed and movable pulleys 240 and 260, shaft cores on which the wires 230 are wound are illustrated, the fixed pulleys 240 are shown as parallel slashes, and the movable pulleys 260 are shown as grid lines. Also, in FIGS. 25A to 26B, the central line is shown as a dot-and-dash line.

Figure 25A:
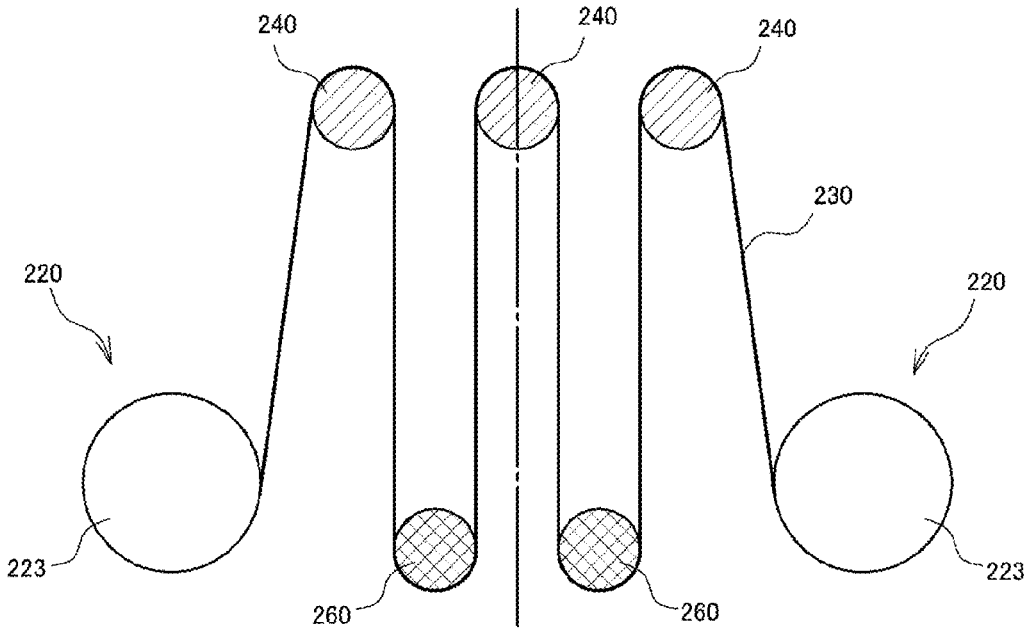
FIGS. 25A and 25B illustrate schematic diagrams illustrating a relation among positions of a driving device, a pulley, and a wire, according to a modified fourth embodiment of the present disclosure.

First, in the modified example shown in FIG. 25A, three fixed pulleys 240 are installed at the installation plate 205 such that one fixed pulley 240 is disposed over the central line and two other fixed pulleys 240 are arranged to be linearly symmetrical with the central line therebetween. Also, two movable pulleys 260 are installed at the support 210 like those of the lifting device 200 according to Embodiment 1. Also, one wire 230 is held by the both driving devices 220. Here, one end of the wire 230 is connected to the driving device 220 on one side, the wire 230 is alternately held by the fixed pulley 240 and the movable pulley 260 to be curved in a zigzag shape, and then the other end thereof is connected to the driving device 220 on the other side. Since the pair of driving devices 220 and two movable pulleys 260 are provided even in the modified example, an effect like that of the lifting device according to Embodiment 1 is obtained. However, since the support 210 is suspended by using one wire 230, when the wire 230 is cut by any cause, there is nothing for suspending the support 210 such that the support 210 instantaneously falls.

Figure 25B:
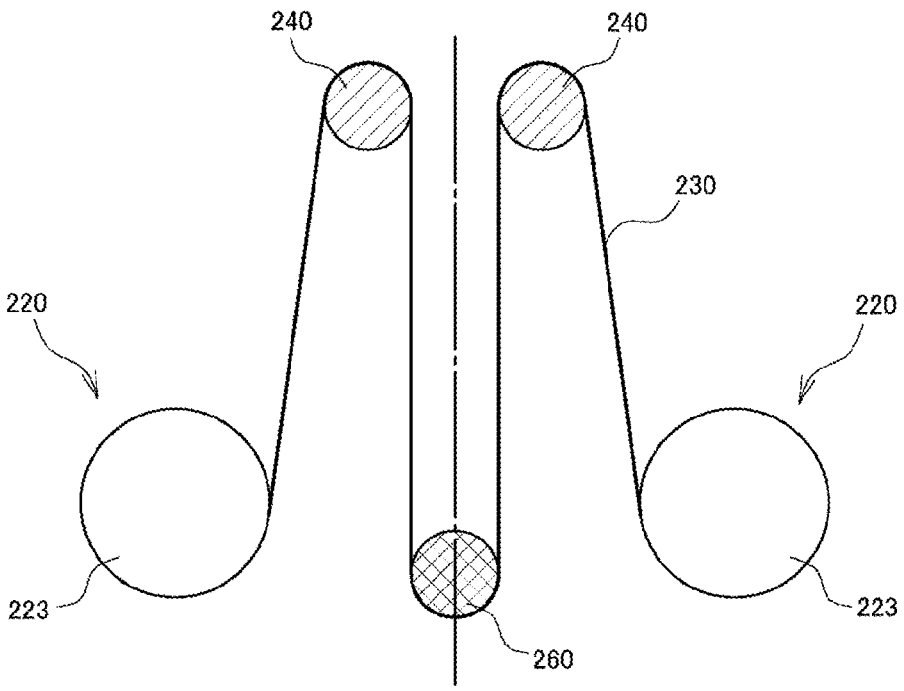

Sequentially, in the modified example shown in FIG. 25B, one movable pulley 260 is installed at the support 210 and is disposed over the central line. Also, two fixed pulleys 240 are installed at the installation plate 205, like those of the lifting device according to the above embodiment. Also, one wire 230 is held by the both driving devices 220. Here, one end of the wire 230 is connected to the driving device 220 on one side, the wire 230 is alternately held by the fixed pulley 240 and the movable pulley 260 to be curved in an M shape, and then the other end thereof is connected to the driving device 220 on the other side. In the modified example, since the number of movable pulleys 260 is reduced in comparison to the lifting device according to Embodiment 1, a load on each of the driving devices 220, generated when the support 210 is lifted, increases. However, since the entire lifting device 200 may be integrated to be compact, a degree of freedom in design of the drawer 20 increases.

Figure 26A:
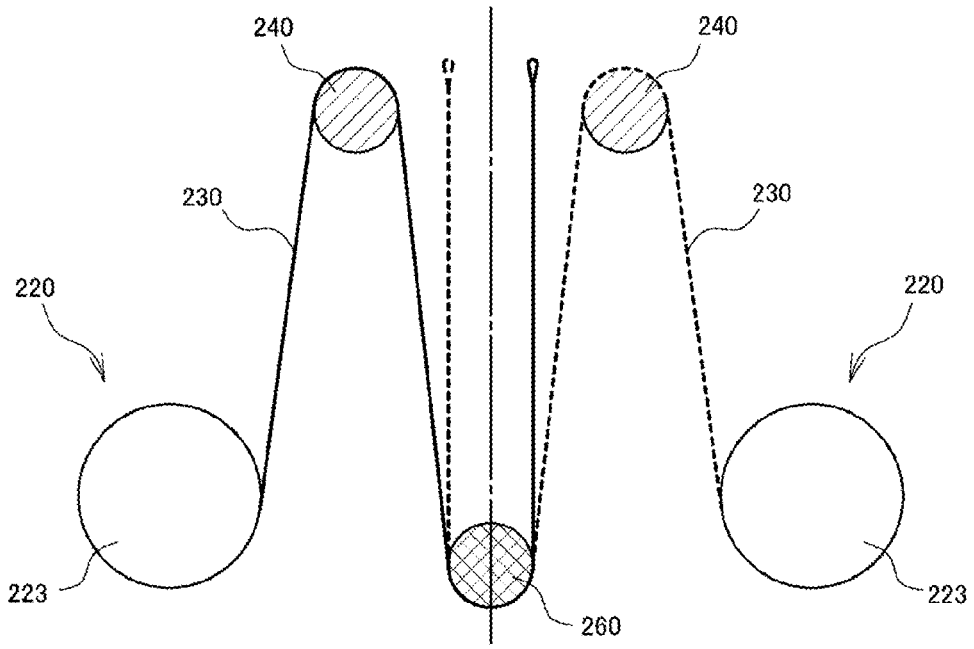
FIGS. 26A and 26B illustrates schematic diagrams illustrating a relation among positions of a driving device, a pulley, and a wire, according to a modified fourth embodiment of the present disclosure.

Sequentially, in the modified example shown in FIG. 26A, one movable pulley 260 is installed at the support 210 and is disposed over the central line. Also, two fixed pulleys 240 are installed at the installation plate 205, like those of the lifting device 200 according to the above embodiment. Also, two wires 230 are installed like those of the lifting device 200 according to Embodiment 1. Also, one end of the wire 230 on one side is connected to the driving device 220 on one side, the wire 230 is sequentially held by the fixed pulley 240 and the movable pulley 260 to be curved in an N shape, and the other end thereof is held by and fixed to the hook 26 of the installation plate 205. Also, one end of the wire 230 on the other side is connected to the driving device 220 on the other side, the wire 230 is sequentially held by the fixed pulley 240 and the movable pulley 260 to be curved in an N shape, and the other end thereof is held by and fixed to the hook 26 of the installation plate 205. Also, the both wires 230 are held by one movable pulley 260 in common. In the modified example, since the number of movable pulleys 260 is reduced in comparison to the lifting device according to Embodiment 1, a load on each of the driving devices 220, is generated when the support 210 is lifted, increases. In certain embodiments, the entire lifting device 200 may be integrated to be compact, a degree of freedom in design of the drawer 20 increases. Also, like the lifting device according to Embodiment 1, the support 210 is suspended by using the two wires 230, even when the wire 230 on one side is cut by any cause, the support 210 remains in a state being suspended by the wire 230 on the other side to be prevented from instantaneously falling.

Figure 26B:
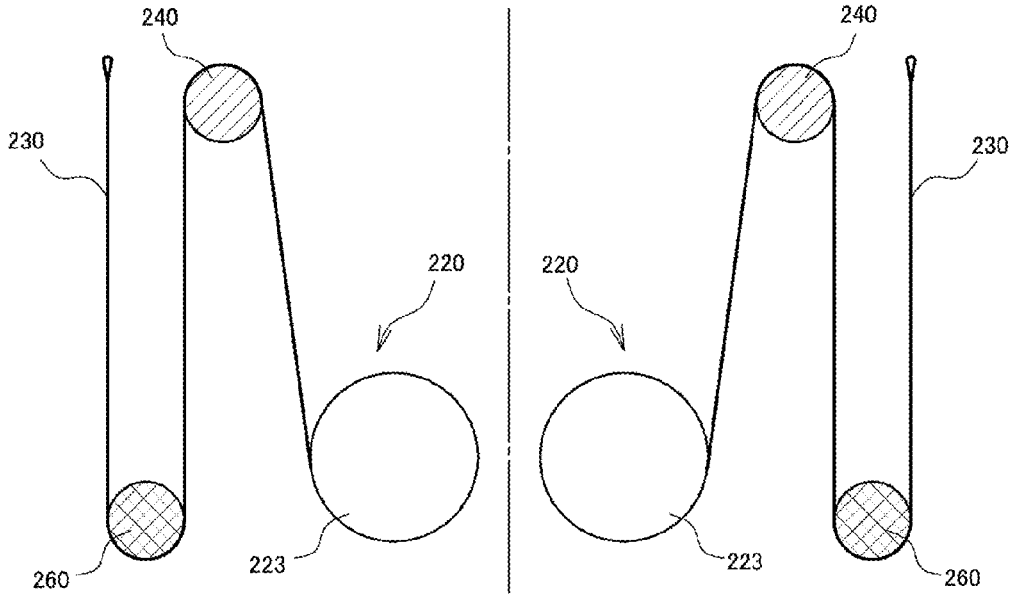

Sequentially, in the modified example shown in FIG. 26B, numbers of the fixed pulleys 240, the movable pulleys 260, and the wires 230 are like those of the lifting device according to Embodiment 1. However, the driving devices 220 are arranged near the central line and the fixed pulleys 240, the movable pulleys 260, and the wires 230 are arranged farther from the central line than the driving devices 220. In this case, since the two movable pulleys 260 are not fixed to the center but arranged on both sides, an inclination of the support 210 is suppressed to become more stable.

As described in the embodiments of the present disclosure, when the fixed pulleys 240, the movable pulleys 260 and the wires 230 are arranged to be linearly symmetrical with the central line therebetween, the fixed and movable pulleys 240 and 260 and the wires 230 may be arranged over the central line.

Also, although encoders are used as detection devices which detect rotation numbers or rotational speeds of the driving motors in the embodiment, sensors which sense induced voltages at coils of the driving motors may be used as the detection devices.

Other Embodiments

Figure 27:
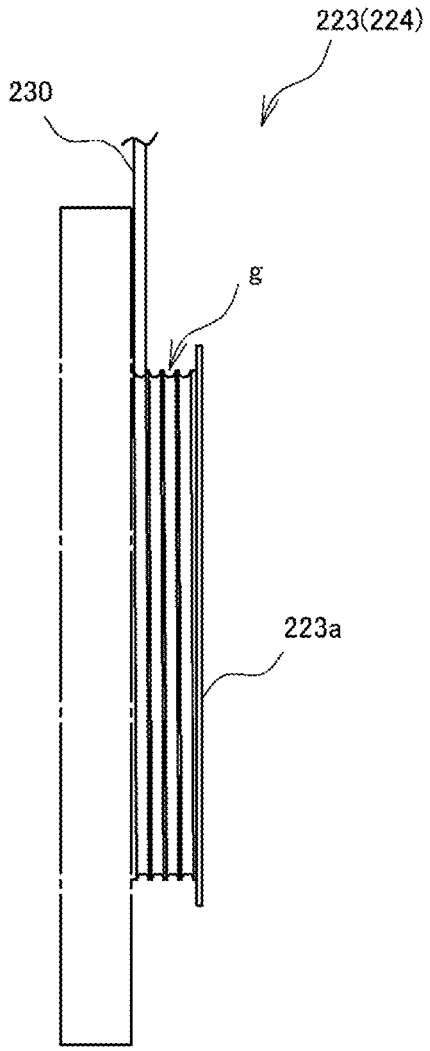
FIG. 27 illustrates a schematic diagram illustrating a second gear, according to an embodiment of the present disclosure.

As other embodiments, as shown in FIG. 27, with respect to the second gear 223 in a winding and unwinding device of the driving device 220, a shaft body 223*a* on which the wire 230 is wound according to rotation of the second gear 223 may be installed and a groove g elongated in a spiral shape in an axial direction may be installed at an outer surface of the shaft body 223*a*. In this configuration, when the wire 230 is wound on the shaft body 223*a*, the wire 230 is guided to the groove g and easily wound. Accordingly, when the wire 230 is wound or unwound, frictions may be restrained, a lifespan of the wire 230 may be extended, and simultaneously frictional sounds may be reduced. Also, this structure may be applied to the third gear 224.

Figure 28A:
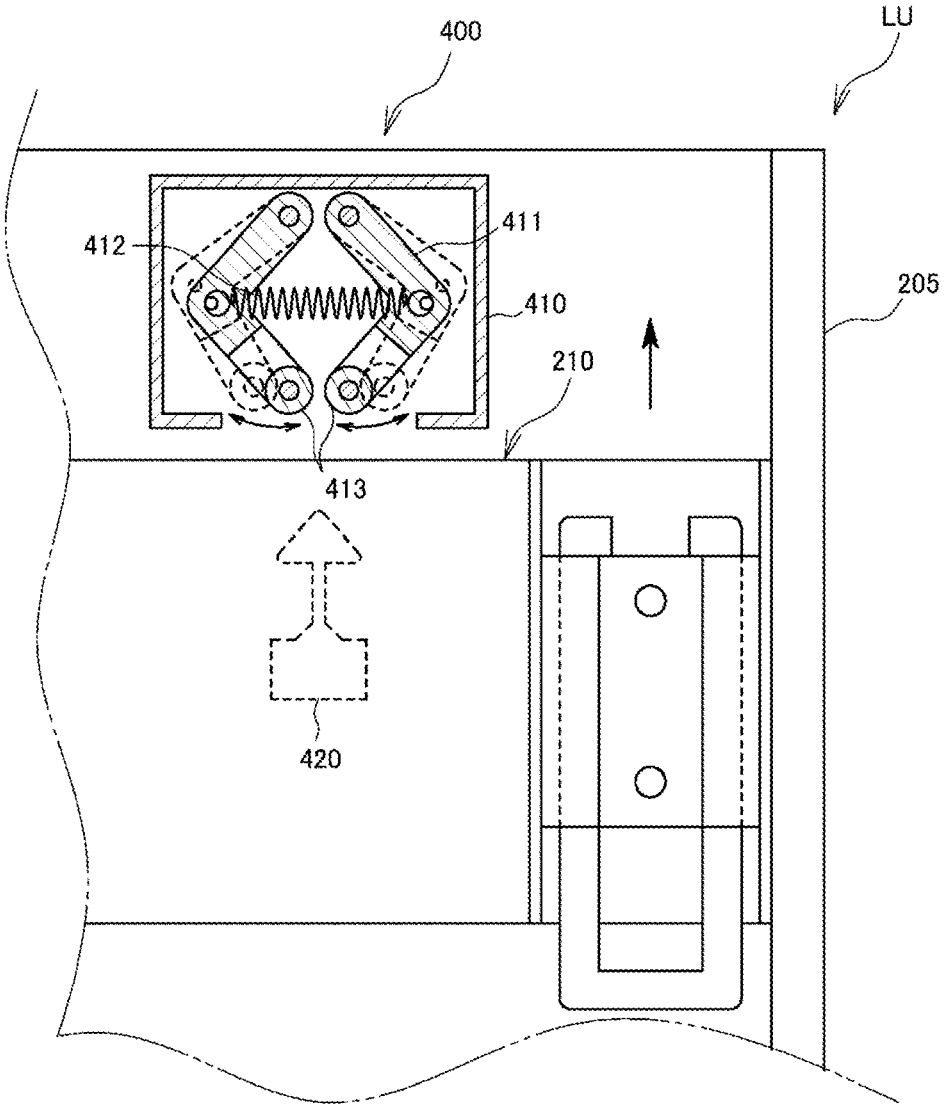
FIGS. 28A and 28B illustrate schematic diagrams illustrating a support retention-support device, according to an embodiment of the present disclosure.
Figure 28B:
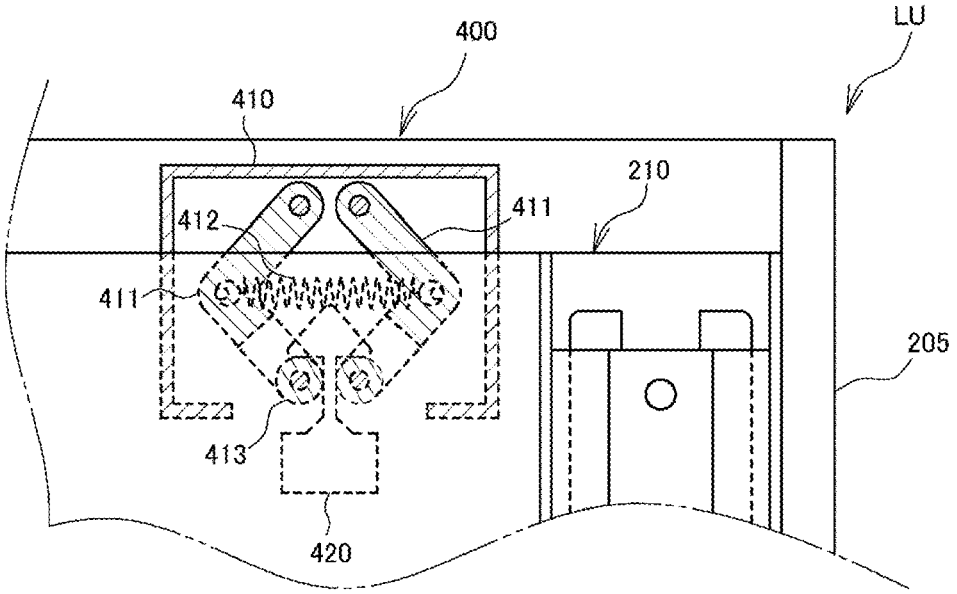

Also, at the lifting device 200, as shown in FIGS. 28A and 28B, a support retention-support device 400 which temporarily retains and supports the support 210 which has moved up to a highest position may be installed. The support retention-support device 400 includes a retention-support unit 410 installed at a top of the installation plate 205 and a retention-support body 420 installed at the support 210. Also, the retention-support unit 410 includes one pair of arms 411 and an elastic body 412 which pulls the pair of arms 411 in a closing direction. Also, rollers 413 which freely rotate are installed at front ends (bottom ends) of the pair of arms 411. Also, the pair of arms 411, shown as a dotted line in FIG. 28A, are configured to be opened and closed as an external force which resists tension of the elastic body 412. Also, the retention-support body 420 has an arrow-shaped front end (a top end) inserted between the pair of arms 411.

As shown in FIG. 28B, when the support 210 has moved up to a highest position, the arrow-shaped front end of the retention-support body 420 is inserted into the pair of arms 411 and remains in a state of being held between the pair of arms 411. Accordingly, the support 210 is temporarily retained and supported by the support retention-support device 400. Also, the tension of the elastic body 412 is set to be elongated when an external force which is greater than a total weight of a weight of the support 210 and a preset maximum support weight of the corresponding support and faces in a moving-down direction is applied to the support 210. Accordingly, when a pulling-down force is applied to the support 210, the retention-support body 420 comes out of a space between the pair of arms 411 such that moving-down of the support 210 is started. Accordingly, the support retention-support device 400 may be applied to a case including a device of pulling the support 210 downward like the lifting device 200 according to Embodiment 3. However, when a device capable of forcibly opening and closing the pair of arms 411 or a latch device which releases retention and support by once moving the support 210 upward is added, the support retention-support device 400 may be applied to the lifting device 200 according to any one of the above embodiments, as an alternative device of the power transfer direction retention-support device.

Also, although the refrigerator including the lifting device is provided in each of the above embodiments, the lifting device according to the embodiment is not limited to the drawer of the refrigerator and may be used for, for example, a drawer of an accommodation member in a washing machine, furniture, kitchen, and the like. Also, for example, there is provided a washing machine in which two washing tubs on top and bottom are included and the bottom washing tub is accommodated in a drawer. In this case, the lifting device or the lifting unit according to the embodiment may be installed at the drawer at the bottom to lift the washing tub itself accommodated in the drawer or laundry in the washing tub.

In addition, the present disclosure is not limited to the embodiments and may be variously modified without departing from the concept thereof.

As is apparent from the above description, a lifting device according to one embodiment of the present disclosure may be installed in a drawer without reducing capacity of the drawer.

Also, according to the lifting device, when moving-down of a support is stopped by any cause during a moving-down operation, unwinding of a wire by a driving device may be stopped and the wire may be prevented from being deviated from a pulley or being loosened in tension.

Also, according to the lifting device, a load on the driving device during a moving-up operation may be reduced.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body comprising a storage compartment;

a drawer insertable or withdrawable into or from the storage compartment;

a support configured to supports an item accommodated in the drawer; and a lifting device configured to lift the support with respect to the drawer, wherein the lifting device comprises:

a driving part configured to provide a driving force to the support;

a wire configured to transfer the driving force of the driving part to the support; and at least one pulley configured to guide the wire, and wherein the driving part comprises:

a winding and unwinding device configured to wind or unwind the wire, a driving motor configured to drive the winding and unwinding device, and a power transfer direction retention-support device provided on a rotating shaft of the driving motor and configured to cut off a load transferred from the wire to the winding and unwinding device.

2. The refrigerator of claim 1, wherein:

the pulley comprises a movable pulley installed at the support, and the support is supported by the wire when the wire is wound by the movable pulley to move up or move down.

3. The refrigerator of claim 1, wherein the support is supported by the wire wound by the winding and unwinding device to move up or move down.

4. The refrigerator of claim 3, wherein:

the power transfer direction retention-support device is provided between the winding and unwinding device and the driving motor.

5. The refrigerator of claim 3, wherein:

the pulley comprises:

a first pulley configured to receive the driving force of the driving motor and rotate forward, and a second pulley configured to rotate backwards interworking with the first pulley, and the wire comprises:

a first wire that is wound by the first pulley and configured to pull the support to allow the support to move up, and a second wire that is wound by the second pulley and configured to pull the support to allow the support to move down.

6. The refrigerator of claim 1, further comprising:

a transition member configured to transition to a different state from a certain state according moving-down of the support;

a transition detection sensor configured to detect a transition amount of the transition member or a related value thereof; and at least one processor configured to stop the driving part based on a change rate of the transition amount or the related value thereof detected by the transition detection sensor.

7. The refrigerator of claim 6, wherein:

the transition member is a belt that moves according to moving-down of the support, and the transition detection sensor is configured to detect a rotation amount of a rotating body that rotates according to a movement of the belt.

8. The refrigerator of claim 6, wherein:

the transition member is a stretchy body that stretches according to moving-down of the support, and the transition detection sensor is configured to detect a tension that change according to stretching of the stretch body.

9. The refrigerator of claim 6, wherein:

the transition member is configured to transition to a different state from a certain state according to moving-up of the support, and the at least one processor is configured to stop the driving part when the transition amount or the related value thereof detected by the transition detection sensor reaches a certain value.

10. A refrigerator comprising:

a body comprising a storage compartment;

a drawer provided to be insertable or withdrawable into or from the storage compartment;

a support configured to supports an item accommodated in the drawer; and a lifting device configured to lift the support with respect to the drawer, wherein the lifting device comprises:

a driving motor;

a first rotating body configured to receive a driving force of the driving motor and rotates forward;

a first wire that is wound by the first rotating body and configured to pull the support to allow the support to move up;

a second rotating body configured to receive the driving force of the driving motor and rotates backward interworking with the first rotating body; and a second wire that is wound by the second rotating body and configured to pull the support to allow the support to move down, and wherein the driving motor comprises:

a winding and unwinding device configured to wind or unwind the wire, a driving motor configured to drive the winding and unwinding device, and a power transfer direction retention-support device provided on a rotating shaft of the driving motor and configured to cut off a load transferred from the wire to the winding and unwinding device.

11. The refrigerator of claim 10, further comprising at least one processor configured to stop driving of the driving motor when tension of the second wire is at least a certain level.

12. The refrigerator of claim 11, further comprising a detection device configured to detect a load on the driving motor, wherein when the load detected by the detection device is at least a certain value, the at least one processor is configured to:

determine that the tension of the at least the certain level occurs at the second wire, and stop driving of the driving motor.

13. The refrigerator of claim 10, further comprising:

n number (n is an integer of 0 or more) of movable pulleys that guide the first wire; and m number (m is an integer of 0 or more) of movable pulleys that guide the second wire, wherein the movable pulleys are installed at the support, wherein when the first rotating body rotates in one direction, a winding amount of the first wire by the first rotating body is X times an unwinding amount of the second wire by the second rotating body, wherein when the first rotating body rotates in the other direction, an unwinding amount of the first wire by the first rotating body is X times a winding amount of the second wire by the second rotating body, and wherein when $n>m$, X is $2(n-m)$, when $n<m$, X is $-1/(2(n-m))$, and when $n=m$, X is 1.

14. A lifting device configured to lift a support that supports an item accommodated in a drawer with respect to the drawer, the lifting device comprising:

a driving part configured to provide a driving force to allow the support to move up or move down with respect to the drawer;

a wire configured to transfer power of the driving part to the support; and at least one pulley configured to guide the wire, and wherein the driving part comprises:

a winding and unwinding device configured to wind or unwind the wire, a driving motor configured to drive the winding and unwinding device, and a power transfer direction retention-support device provided on a rotating shaft of the driving motor and configured to cut off a load transferred from the wire to the winding and unwinding device.

15. The lifting device of claim 14, wherein:

the pulley comprises a movable pulley installed at the support, and the support is moved up or moved down by the wire connected to the movable pulley.

16. The lifting device of claim 14, wherein the support is supported by the wire wound by the winding and unwinding device to move up or move down.

17. The lifting device of claim 16, wherein:

the power transfer direction retention-support device is provided between the winding and unwinding device and the driving motor.

18. The lifting device of claim 16, further comprising at least one processor configured to control an operation of elements of the driving part, wherein when any one element of the driving part is stopped, the at least one processor is configured to stop other parts of the driving part.

19. The lifting device of claim 14, wherein the driving part comprises:

a driving motor;

a worm gear connected to the driving motor; and a winding and unwinding device that is connected to the worm gear and configured to wind and unwind the wire.

20. The lifting device of claim 14, further comprising:

a support retention-support device configured to:

retain and support the support when the support has moved up, and configured to release retention and support when an external force that is greater than a total weight of a weight of the support and a maximum support weight preset with respect to the support and faces a moving-down direction is applied to the support.

* * * * *